US009473858B2

(12) United States Patent
Pedersen et al.

(10) Patent No.: US 9,473,858 B2
(45) Date of Patent: Oct. 18, 2016

(54) HEARING DEVICE

(71) Applicant: OTICON A/S, Smørum (DK)

(72) Inventors: Michael Syskind Pedersen, Smørum (DK); Thomas Kaulberg, Smørum (DK); Anders Thule, Smørum (DK); Steen Michael Munk, Smørum (DK); Karsten Bo Rasmussen, Smørum (DK)

(73) Assignee: OTICON A/S, Smorum (DK)

( * ) Notice: Subject to any disclaimer, the term of this patent is extended or adjusted under 35 U.S.C. 154(b) by 0 days.

(21) Appl. No.: 14/716,421

(22) Filed: May 19, 2015

(65) Prior Publication Data

US 2015/0341730 A1 Nov. 26, 2015

(30) Foreign Application Priority Data

May 20, 2014 (EP) ..... 14169059

(51) Int. Cl.
*H04R 25/00* (2006.01)

(52) U.S. Cl.
CPC ..... *H04R 25/407* (2013.01); *H04R 25/405* (2013.01); *H04R 25/453* (2013.01)

(58) Field of Classification Search
CPC .. H04R 25/43; H04R 25/405; H04R 25/407; H04R 25/453
See application file for complete search history.

(56) References Cited

U.S. PATENT DOCUMENTS

| | | | | |
|---|---|---|---|---|
| 6,424,721 | B1 * | 7/2002 | Hohn | H04R 25/405 381/313 |
| 7,274,794 | B1 * | 9/2007 | Rasmussen | H04R 3/005 381/92 |
| 2002/0041695 | A1 * | 4/2002 | Luo | H04R 3/005 381/313 |
| 2008/0260175 | A1 * | 10/2008 | Elko | H04R 3/005 381/73.1 |
| 2010/0092016 | A1 * | 4/2010 | Iwano | H04R 25/407 381/313 |
| 2013/0170680 | A1 * | 7/2013 | Gran | H04R 25/405 381/313 |
| 2013/0188816 | A1 * | 7/2013 | Bouse | H04R 25/43 381/320 |

* cited by examiner

*Primary Examiner* — Matthew Eason
(74) *Attorney, Agent, or Firm* — Birch, Stewart, Kolasch & Birch, LLP

(57) ABSTRACT

A hearing device comprising a first and a second input sound transducers, a processing unit, and an output sound transducer. The first transducer is configured to be arranged in an ear canal or in the ear of the user, to receive acoustical sound signals from the environment and to generate first electrical acoustic signals from the received acoustical sound signals. The second transducer is configured to be arranged behind a pinna or on, behind or at the ear of the user, to receive acoustical sound signals from the environment and to generate second electrical acoustic signals from the received acoustical sound signals. The processing unit is configured to process the first and second electrical acoustic signals. The output sound transducer is configured to be arranged in the ear canal of the user and to generate acoustical output sound signals from electrical acoustic signals.

18 Claims, 19 Drawing Sheets

HEARING DEVICE

FIELD

The invention relates to a hearing device comprising a first input sound transducer and an output sound transducer (receiver) configured to be arranged in an ear canal or in an ear of a user and a second input sound transducer configured to be arranged behind a pinna or on/behind or at the ear of the user.

DESCRIPTION

Hearing or auditory perception is the process of perceiving sounds by detecting acoustical vibrations with a sound vibration input. Mechanical vibrations, i.e., sound waves, are time dependent changes in pressure of a medium, e.g., air, surrounding the sound vibration input, e.g., an ear. The human ear has an external portion called auricle or pinna, which serves to direct and amplify sound waves to an ear canal, which ends at an eardrum, the so-called tympanic membrane.

The pinna serves to collect sound by acting as a funnel, which may amplify sound pressure level by about 10 to 15 dB in a frequency range of 1.5 kHz to 7 kHz. Further the cavities and elevations of the pinna serve for vertical sound localization by working as a direction dependent filter system, which performs a frequency dependent amplitude modulation. Some frequencies of the incoming sound waves are amplified by the pinna and others are attenuated, which allows distinguishing between the angle of incidence on the vertical plane.

The ear canal has a sigmoid tube like shape which is open on one side to the environment with a typical length of about 2.3 cm and a typical diameter of about 0.7 cm. Sound waves running through the ear canal are amplified in the frequency range of about 3 kHz to 4 kHz, corresponding to the fundamental frequency of a tube closed on one end. The ear canal has an outer flexible portion of a cartilaginous tissue covering about one third of the ear canal, which connects to the pinna. An inner bony portion covers the other two thirds of the ear canal, which ends at the ear drum. The ear drum receives the sound waves amplified by the pinna and the ear canal.

A speaker, also called receiver, of a hearing aid device can be arranged in the ear canal, near the eardrum, of a hearing impaired user in order to amplify sounds from the acoustic environment to allow the user to perceive the sound. Hearing aid devices can be worn on one ear, i.e. monaurally, or on both ears, i.e. binaurally. Binaural hearing aid devices comprise two hearing aids, one for a left ear and one for a right ear of the user. The binaural hearing aids can exchange information with each other wirelessly and allow spatial hearing.

Hearing aids typically comprise microphone(s), an output sound transducer, e.g., speaker or receiver, electric circuitry, and a power source, e.g., a battery. The microphone(s) receives an acoustical sound signal from the environment and generates an electrical acoustic signal representing the acoustical sound signal. The electrical acoustic signal is processed, e.g., frequency selectively amplified, noise reduced, adjusted to a listening environment, and/or frequency transposed or the like, by the electric circuitry and a processed acoustical output sound signal is generated by the output sound transducer to stimulate the hearing of the user. In order to improve the hearing experience of the user, a spectral filterbank can be included in the electric circuitry, which, e.g., analyses different frequency bands or processes electrical acoustic signals in different frequency bands individually and allows improving the signal-to-noise ratio.

Typically, the microphones of the hearing aid device receiving the incoming acoustical sound signal are omnidirectional, meaning that they do not differentiate between the directions of the incoming sound. In order to improve the hearing of the user, a beamformer can be included in the electric circuitry. The beamformer improves the spatial hearing by suppressing sound from other directions than a direction defined by beamformer parameters, i.e., a look vector. In this way, the signal-to-noise ratio can be increased, as mainly sound from a sound source, e.g., in front of the user is received. Typically, a beamformer divides the space in two subspaces, one from which sound is received and the rest, where sound is suppressed, which results in spatial hearing.

One way to characterize hearing aid devices is by the way they fit to an ear of the user. Conventional hearing aids include for example ITE (In-The-Ear), RITE (Receiver-In-The-Ear), ITC (In-The-Canal), CIC (Completely-In-the-Canal), and BTE (Behind-The-Ear) hearing aids. The components of the ITE hearing aids are mainly located in an ear, while ITC and CIC hearing aid components are located in an ear canal. BTE hearing aids typically comprise a Behind-The-Ear unit, which is generally mounted behind or on an ear of the user and which is connected to an air filled tube that has a distal end that can be fitted in an ear canal of the user. Sound generated by a speaker can be transmitted through the air filled tube to an ear drum of the user's ear canal. RITE hearing aids typically comprise a BTE unit arranged behind or on an ear of the user and an ITE unit with a receiver that is arranged to be positioned in the ear canal of the user. The BTE unit and ITE unit are typically connected via a lead. An electrical acoustic signal can be transmitted to the receiver arranged in the ear canal via the lead.

Hearing aid users with hearing aids that have at least one insertion part configured to be inserted into an ear canal of the user to guide the sound to the ear drum experience various acoustic effects, e.g., a comb filter effect, sound oscillations or occlusion. Simultaneous occurrence of natural sound and device-generated sound in an ear canal of the user creates the comb filter effect, as the natural sound and device-generated sounds reach the eardrum with a time delay. Sound oscillations generally occur for hearing aid devices including a microphone, with the sound oscillations being generated through sound reflections off the ear canal to the microphone of the hearing aid device. A common way to suppress the aforementioned acoustic effects is to close the ear canal, which effectively prevents natural sound to reach the ear drum and device generated sound to leave the ear canal. Closing the ear canal, however, leads to the occlusion effect, which corresponds to an amplification of a user's own voice when the ear canal is closed, as bone-conducted sound vibrations cannot escape through the ear canal and reverberate off the insertion part of the hearing aid device.

Using a microphone in the ear canal allows using the amplification from the pinna. However, this also increases acoustic and mechanical feedback from the speaker arranged in the ear canal, as sound generated in the ear canal is reverberated by the ear canal walls and received by the microphone in the ear canal. A microphone behind or on the ear receives less sound from the receiver in the ear canal. The microphone behind or on the ear, however, will amplify sounds impinging from behind more than sounds impinging from the front, and consequently the spatial cue preservation will be worse.

Therefore, there is a need to provide an improved hearing device.

SUMMARY

According to an embodiment, a hearing device comprising a first input sound transducer, a second input sound transducer, a processing unit, and an output sound transducer is disclosed. The first input sound transducer is configured to be arranged in an ear canal or in the ear of the user, and to receive acoustical sound signals from the environment for generating a first electrical acoustic signal in accordance with the received acoustical sound signals. The second input sound transducer is configured to be arranged behind a pinna or on/behind or at the ear of the user, and to receive acoustical sound signals from the environment for generating a second electrical acoustic signals in accordance with the received acoustical sound signals. The processing unit is configured to process the first and second electrical acoustic signals. The processing unit is further configured to determine a first level of the first electrical acoustic signal, a second level of the second electrical acoustic signal, and a level difference between the first level and second level and to use the level difference to process the first electrical acoustic signal and/or second electrical acoustic signal for generating an electrical output sound signal. The output sound transducer, arranged in the ear canal of the user, is configured to generate an acoustical output sound signal in accordance with the electrical output sound signal. The output sound transducer may also be configured to generate acoustical output sound signals in accordance with electrical acoustic signals.

The first input sound transducer, e.g. a microphone, and the output sound transducer, e.g. a speaker or receiver, can be comprised in an insertion part, e.g. an In-The-Ear unit, configured to be arranged in the ear or in the ear canal of the user. The other components of the hearing device, including the second input transducer, can be comprised in a Behind-The-Ear unit configured to be arranged behind the pinna or on/behind or at the ear of the user. The value of the level difference may be limited to a threshold value of level difference to avoid feedback issues or generating level difference based electrical output acoustical signal in atypical scenarios such as scratching at or close to one of the microphones of the hearing device.

In one embodiment of the invention, the use of the level difference of the electrical acoustic signals generated by the two input sound transducers at different locations with respect to the output sound transducer allows for improving the sound quality provided to the user in the acoustical output sound signal, as generated by the output sound transducer. In another embodiment of the disclosure, the hearing device allows for improving the directional response in the acoustical output sound signal. This means that using the level difference to process the electrical acoustic signals improves spatial hearing of the user. In yet another embodiment of the disclosure, the consonant part of the speech may be enhanced, thus improving the reception of speech. Furthermore, the design-freedom for a housing enclosing at least part of the hearing device is increased, as only one microphone has to be placed in the Behind-The-Ear part of the hearing device. In another embodiment, the distance between the two input sound transducers is increased, thus allowing for achieving improved directivity for lower frequencies. The increase in the distance is in relation to a typical hearing instrument where the microphone distance is generally approximately 10 mm.

In yet another embodiment, the hearing device may comprise microelectromechanical system (MEMS) components, e.g. MEMS microphones and balanced speakers, thus allowing for manufacturing the hearing device with a very small insertion part with good mechanical decoupling. In an embodiment, a housing comprising the balanced speakers/speaker may be at least partially enclosed by an expandable balloon, which may be permanent or detachable and can be replaced. The balloon includes a sound exit hole, through which output sound signal is emitted for the user of the hearing device. Using the expandable balloon improves the fit of the earpiece in the ear canal. Such balloon arrangement is provided in US2014/0056454A1, which is incorporated herein by reference. In other scenarios, instead of the expandable balloon, conventionally known domes or moulds may also be used.

In an embodiment of the disclosure, the processing unit is configured to compensate the first electrical acoustic signal and/or the second electrical acoustic signal by the determined level difference between the first electrical acoustic signal and second electrical acoustic signal. The compensation may, for example be performed by multiplication of a gain factor to the respective electrical acoustic signal. The processing unit may be configured to process the first electrical acoustic signal and second electrical acoustic signal for generating an electrical output acoustical signal by using the first electrical acoustic signal or the second electrical acoustic signal or a combination of the first and the second electrical acoustic signal to generate the electrical output sound signal.

A combination of the first electrical acoustic signal and the second electrical acoustic signal can for example be a weighted sum of the first electrical acoustic signal and the second electrical acoustic signals. The weight factor may depend on the feedback between one or more of the input sound transducers to the output sound transducer or feedback estimates determined by the hearing device, e.g. through or during fitting. It is to be noted that the weight is not necessarily scalar. It could as well be a filter such as an FIR filter or the weight could as well consist of complex numbers in a frequency domain.

In one embodiment, the first electrical acoustic signal and the second electrical acoustic signal can be combined, where one electrical acoustic signal is delayed compared to the another electrical acoustic signal for example, the second electrical acoustic signal is delayed compared to the first electrical acoustic signal. The delay could e.g. be in the range of 1-10 ms. A weight is applied to both the first and the second electrical signal. The ratio of the weights may depend on the estimated feedback paths. By delaying the second microphone signal compared to the first microphone signal, a higher gain may be obtained by applying most of the weight of the BTE microphone signal, while maintaining correct spatial perception by allowing the first wavefront of the mixed sound to origin from the ITE microphone. The delay between the first and the second microphones on the two hearing instruments being used for the left ear and the right ear set up in a binaural system could be different. Hereby the perceived coloration due to the comb-filter effect is reduced as the notches on the two instruments will occur at different frequencies.

In an embodiment, the use of the level difference allows to compensate for a location difference of the two input sound transducers in order to use an input sound transducer location which might be less optimal with respect to the spatial cue preservation but more optimal with respect to minimizing feedback.

In one embodiment, the processing unit is configured to use the level difference between the first electrical acoustic signal and second electrical acoustic signal to determine a direction of a sound source of the acoustical sound signal with respect to the input sound transducers for generating an input sound transducer directivity pattern. The processing unit can be further configured to amplify and/or attenuate the first electrical acoustic signal or the second electrical acoustic signal or a combination of the first electrical acoustic signal and second electrical acoustic signal for generating an electrical output acoustical signal in dependence of the input sound transducer directivity pattern. The direction of the sound source can for example be determined by comparing the levels at the first input sound transducer and second input sound transducer. In one embodiment, the processing unit determines the sound to be received from a front direction, if the level at the first input sound transducer is higher than the level at the second input sound transducer because for the second input sound transducer, the pinna shadows sounds approaching from the front but for the first input sound transducer, the pinna amplifies sounds approaching from the front. Additionally or alternatively, the processing unit determines the sound to be to be received from the rear direction, if the level at the first input sound transducer is lower than the level of the second at the second input sound transducer, because the pinna in this case shadows sounds approaching from the rear for the first input sound transducer. Comparison of the levels determined from the electrical acoustic signals received by both input sound transducers (microphones), a determination for a direction of the sound source can be made.

The hearing device may also include a filter-bank configured to filter each electrical acoustic signal into a number of frequency channels, each comprising an electrical sub-band acoustic signal. The processing unit can further be configured to determine a level of sound for each electrical sub-band acoustic signal. In one embodiment, the processing unit is configured to determine a level difference between the first electrical sub-band acoustic signal and the second electrical sub-band acoustic signal in at least a part of the frequency channels. The processing unit can further be configured to convert the level difference into a gain. The processing unit can also be configured to apply the gain to at least a part of the electrical sub-band acoustic signals.

The first input sound transducer and the second input sound transducer may have different frequency responses. Therefore, the offset between the sound levels resulting from the different frequency response can for example be removed by high-pass filtering the level difference before it is converted into a gain.

In one embodiment, the processing unit is configured to determine whether the level of the first electrical sub-band acoustic signal or the level of the second electrical sub-band acoustic signal is higher. Based on the result which level is higher, the processing unit can be configured to convert the level difference in a direction-dependent gain. The direction-dependent gain is adapted to amplify the electrical acoustic signal, if the level of the first electrical sub-band acoustic signal is higher than the level of the second electrical sub-band acoustic signal and to attenuate the electrical acoustic signal, if the level of the first electrical sub-band acoustic signal is lower than the level of the second electrical sub-band acoustic signal. The gain may have a functional dependence on the level difference, e.g., a linear dependence or any other functional dependence, i.e., the gain is higher/lower for higher/lower level difference.

The processing unit can also be configured to determine the gain and/or the direction-dependent gain in dependence of an overall level of sound of the first electrical acoustic signal and the second electrical acoustic signal.

In one embodiment, the processing unit is configured to determine feedback frequency channels that do not fulfil a feedback stability criterion. The processing unit can also be configured to determine non-feedback frequency channels that fulfil a feedback stability criterion. Alternatively or additionally, the processing unit can be configured to determine feedback frequency channels and non-feedback frequency channels corresponding to predetermined data comprising feedback and non-feedback frequency channel information. A feedback stability criterion can for example be a Lyapunov criterion, a circle criterion or any other criterion such as comparing magnitude of the frequency domain feedback path estimate to a given limit that allows determining if a frequency channel is prone to feedback. The feedback frequency channels can also be determined by comparison of a determined level of sound in the frequency channel and a predetermined level threshold value indicating feedback. Alternatively or additionally, the feedback frequency channels can also be determined by comparison of a determined level difference of sound in the frequency channel and a predetermined level difference threshold value indicating feedback. The feedback channels can be determined in a fitting procedure step, e.g., by sending a test sound signal generated by a sound generation unit and analysing the test sound signal in the frequency channels. The test sound may also include a sound played during a start up of the hearing aid and/or by a user request such as using a smartphone app communicating with the hearing aid. The test sound may consists of sine tones, it be a sine sweep or may also be a Gaussian noise limited to certain frequency bands. If the test sound should also be used for estimating the delay between the microphones, lower frequencies, where feedback is less likely, may also be included. The determination of feedback frequency channels can also be performed during the operation of the hearing device, e.g., by sending a non-audible test sound signal, i.e. a sound signal non-audible to humans with a frequency of for example 20 kHz or higher, to determine a feedback path between the two microphones and the speaker of the hearing device. The feedback path estimate for the non-audible test sound signal can then be used to determine an estimated feedback for other frequency channels.

In one embodiment, the processing unit is configured to use second electrical sub-band acoustic signals from feedback frequency channels and first electrical sub-band acoustic signals from non-feedback frequency channels in order to generate the electrical output sound signal. That is, the processing unit is configured to apply the direction-dependent gain to second electrical sub-band acoustic signals from feedback frequency channels and to first electrical sub-band acoustic signals from non-feedback frequency channels in order to generate the electrical output sound signal. In another embodiment, the processing unit can further be configured to compensate each respective first or second electrical sub-band acoustic signal or a combination of the respective first and second electrical sub-band acoustic signal from each respective feedback frequency channel in dependence of the level difference between the first and second electrical sub-band acoustic signal.

The hearing device can comprise one or more low-pass filters that are adapted to filter a magnitude of each electrical acoustic signal and/or electrical sub-band acoustic signal in order to determine a level of sound. The electrical acoustic signals can for example be Fourier transformed by an FFT, DFT or other frequency transformation schemes performed on the processing unit in order to transform the electrical acoustic signals in the frequency domain and to derive the magnitude of an electrical sub-band acoustic signal of a certain frequency channel.

In one embodiment, the hearing device comprises a calculation unit. The calculation unit can also be included in the processing unit. The calculation unit can be configured to calculate a magnitude or a magnitude squared of each of the electrical acoustic signals and/or electrical sub-band acoustic signals in order to determine a level of sound for each electrical acoustic signal and/or electrical sub-band acoustic signal.

In one embodiment, the processing unit is configured to estimate a feedback path between the first input sound transducer and the output sound transducer. The processing unit can further be configured to estimate a feedback path between the second input sound transducer and the output sound transducer. The feedback path can be estimated online, e.g., based on the acoustical sound signal or a non-audible test sound signal. The feedback path can also be estimated offline during a fitting of the hearing device. Alternatively or additionally, the feedback path can also be estimated each time after the hearing device is mounted and/or turned on. The feedback path can for example be estimated by using audible or non-audible test sound signals generated by a sound generation unit of the hearing device or stored in a memory of the hearing device. The feedback path may also be estimated online, and the microphone weights may be adjusted adaptively according to the changing feedback estimate. The test sound signals preferably comprise a non-zero level of sound for frequencies that are prone to feedback. The feedback frequency channels and non-feedback frequency channels can then be determined based on the determination of the feedback paths. If feedback is detected in one of the frequency channels, the processing unit can be configured to use the second electrical acoustic signal for said feedback frequency channel only for a predetermined time interval. After the predetermined time interval is over, the processing unit can be configured to use the first electrical acoustic signal for said feedback frequency channel again in order to test whether the feedback is still present in said feedback frequency channel. If feedback is likely to occur in said feedback frequency channel, i.e., a predetermined number of feedback howls occurs over a predetermined amount of time, the processing unit can be configured to use the second electrical acoustic signal in said feedback frequency channel permanently for generating the electrical output acoustical signal for said frequency channel. It is also possible to use a weighted sum of first and second electrical acoustic signals of a specific frequency channel to generate the electrical output acoustical signal for said specific frequency channel. The weighted sum may be in the form of $w_{ITE}(f)X_{ITE}(f)+w_{BTE}(f)X_{BTE}(f)$, where $w_{ITE}(f)$ and $w_{BTE}(f)$ are the (complex) weights at the frequency band f applied to the two signals $X_{ITE}(f)$ and $X_{BTE}(f)$, respectively. Depending on the weights, one can have a tradeoff between good localization ($w_{ITE}$ dominant) and less feedback ($W_{BTE}$ dominant), ITE referring to in-the-ear and BTE referring to behind-the-ear.

In one embodiment, the two input sound transducers and the output sound transducer are arranged in the same or substantially same horizontal plane. The processing unit can be configured to determine a cross correlation between the feedback path between the first input sound transducer and the output sound transducer and the feedback path between the second input sound transducer and the output sound transducer. It is to be noted that the cross correlation at lower frequencies will be useful for estimating the delay between the microphone signals as the delay will be less influenced from the acoustic properties related to the pinna and the head shadow. The processing unit can further be configured to use the cross correlation to determine a distance between the first input sound transducer and the second input sound transducer or time delay or phase difference between the microphone signals. The processing unit can also be configured to select a directional filter optimized for the directionality in lower frequencies based on the distance between the first input sound transducer and the second input sound transducer or time delay or phase difference between the microphone signals. Additionally or alternatively, the first input sound transducer and second input sound transducer can be arranged in the horizontal plane in a manner to maximise the distance between the two input sound transducers. Preferably, the first input sound transducer is as close to the eardrum as possible, while being as far away from the output sound transducer as possible to reduce feedback. For example, the first input sound transducer can be arranged at the entrance of the ear canal and the second input sound transducer can be arranged behind the pinna in a horizontal plane with the first input sound transducer. Additionally and alternatively, the microphone array including the first input sound transducer and the second input sound transducer are not only in the same horizontal plane but the microphone array is parallel to the front-back axis of the head. This would be the case when the ITE microphone is positioned at the entrance of the ear canal. The positioning of the first input sound transducer relative to the second input sound transducer result in increased distance along the horizontal plane, for example increasing the distance to around 30 mm. Lower frequencies require longer distances between the microphones due to the longer wavelength of the lower-frequency sound signals. Therefore, the increased distance, relative to a typical hearing aid microphone distance, between the two input sound transducers allow for achieving improved directivity for lower frequencies. It may also be possible to include a sensor or the like configured to determine the relative positioning of the input sound transducers and have accurate information on the distance, which may be important to the directivity processing. The differential beamformer will be less efficient at low frequencies because the microphone signals are subtracted from each other. As the frequency becomes lower, subtraction takes place between two DC signals. This means that the resulting beamformer will be highpass-filtered with a frequency response proportional to sin(2*pi*f*d/c), where f is the frequency, d is the microphone distance, and c is the sound velocity. At some point, the microphone noise becomes dominant, and the beamformer becomes less efficient. For example, doubling the microphone distance d, the low frequency roll-off will be shifted down in frequency by one octave.

In an embodiment, at least one of the input sound transducers such as the first input sound transducer can be a microelectromechanical system (MEMS) microphone. In one embodiment, all input sound transducers are MEMS microphones. In one embodiment, the hearing device comprises mainly MEMS components in order to produce a small and lightweight hearing device.

The hearing device can further comprise a beamformer configured to enhance the directivity pattern for low frequencies. Preferably, the beamformer is used when the input sound transducers are arranged in a horizontal plane and the distance between the input sound transducers is known, such that the input sound transducers form an input sound transducer array, e.g. a microphone array. The beamformer can for example be a delay and subtract beamformer. The beamformer is preferably used for electrical acoustic signals with low frequencies and can be combined with electrical acoustic signals with high frequencies, which have been processed by the processing unit therefore allowing to synthesize an electrical output acoustical signal with low frequency parts processed by the beamformer and high frequency parts processed by the processing unit.

In an embodiment, the disclosure relates to a method for processing acoustical sound signals from the environment comprising feedback. The method comprises a step of receiving an acoustical sound signal in an ear or in an ear canal of a user and generating a first electrical acoustic signal and receiving the acoustical sound signal behind a pinna or on/behind or at the ear of the user and generating a second electrical acoustic signal. The method further comprises a step of estimating the level of sound of the first and the second electrical acoustic signal. Furthermore, the method comprises a step of determining the level difference between the first electrical acoustic signal and the second electrical acoustic signal. Another step of the method is converting the value of the level difference into a gain value. Finally, the method comprises the step of applying the gain to the first acoustic signal or second electrical acoustic signal or a combination of the first and second electrical acoustic signal to generate an output sound signal.

In yet another embodiment, the disclosure further relates to a method for processing acoustical sound signals from the environment with the following steps. The method comprises the step of receiving an acoustical sound signal in an ear or in an ear canal of a user and generating a first electrical acoustic signal and receiving the acoustical sound signal behind a pinna or on/behind or at the ear of the user and generating a second electrical acoustic signal. The method further comprises the step of filtering the electrical acoustic signals into frequency channels generating first electrical sub-band acoustic signals and second electrical sub-band acoustic signals. Furthermore, the method comprises the step of estimating the level of sound of each first electrical sub-band acoustic signal and second electrical sub-band acoustic signal in each frequency channel. The method further comprises the step of determining the level difference between each first and second electrical sub-band acoustic signal in the respective frequency channel. The method also comprises the step of converting the value of the level difference into a gain value for each frequency channel. Furthermore, the method comprises the step of applying the gain to electrical sub-band acoustic signals. The method also comprises the step of synthesizing an output sound signal from the electrical sub-band acoustic signals.

In an embodiment, instead of estimating a level of sound between the first electrical sub-band acoustic signal and second electrical sub-band acoustic signal in each frequency channel for level difference determination, one can envisage estimating the level between the first electrical sub-band acoustic signal and a weighted sum of the first electrical sub-band acoustic signal and the second electrical sub-band acoustic signal. In another embodiment, the level between the second electrical sub-band acoustic signal and a weighted sum of the first electrical sub-band acoustic signal and the second electrical sub-band acoustic signal may also be used.

In one embodiment of the method, the gain is applied to the second electrical sub-band acoustic signals in feedback frequency channels, which do not fulfil a feedback stability criterion in order to generate compensated second electrical sub-band acoustic signals in the feedback frequency channels. The gain can also be applied to the first electrical sub-band acoustic signals in non-feedback frequency channels, which fulfil a feedback stability criterion in order to generate compensated first electrical sub-band acoustic signals in the non-feedback frequency channels. Additionally an output sound signal can be synthesized from the compensated second electrical sub-band acoustic signals and the compensated first electrical sub-band acoustic signals.

In one embodiment of the method, the step of converting the value of the level difference into a gain value for each frequency channel, results in the value of the level difference that represents direction-dependent gain value. The direction-dependent gain value is adapted to amplify the electrical acoustic signal, if the level of the first electrical sub-band acoustic signal is higher than the level of the second electrical sub-band acoustic signal and to attenuate the electrical acoustic signal, if the level of the first electrical sub-band acoustic signal is lower than the level of the second electrical sub-band acoustic signal. The direction dependent gain can be applied to electrical sub-band acoustic signals. Additionally an output sound signal can be synthesized from the electrical sub-band acoustic signals.

The gain value used in the method can be limited to a predetermined threshold gain value.

The disclosure further relates to the use of the hearing device of an embodiment of the disclosure, in order to perform at least some of the steps of one of the methods for processing acoustical sound signals from the environment.

BRIEF DESCRIPTION OF ACCOMPANYING FIGURES

The present disclosure will be more fully understood from the following detailed description of embodiments thereof, taken together with the drawings in which:

FIG. 1 shows a schematic illustration of an embodiment of a hearing aid according to an embodiment of the disclosure;

FIG. 2A shows a schematic illustration of a configuration of an embodiment of a hearing aid comprising an insertion part and a Behind-The-Ear unit arranged at an ear of a user according to an embodiment of the disclosure; FIG. 2B, relating to FIG. 2A, shows a schematic illustration of a configuration of an embodiment of a hearing aid comprising an insertion part and a Behind-The-Ear unit arranged at an ear of a user according to an embodiment of the disclosure;

Figures 17A, 17B, 17C, 17D:
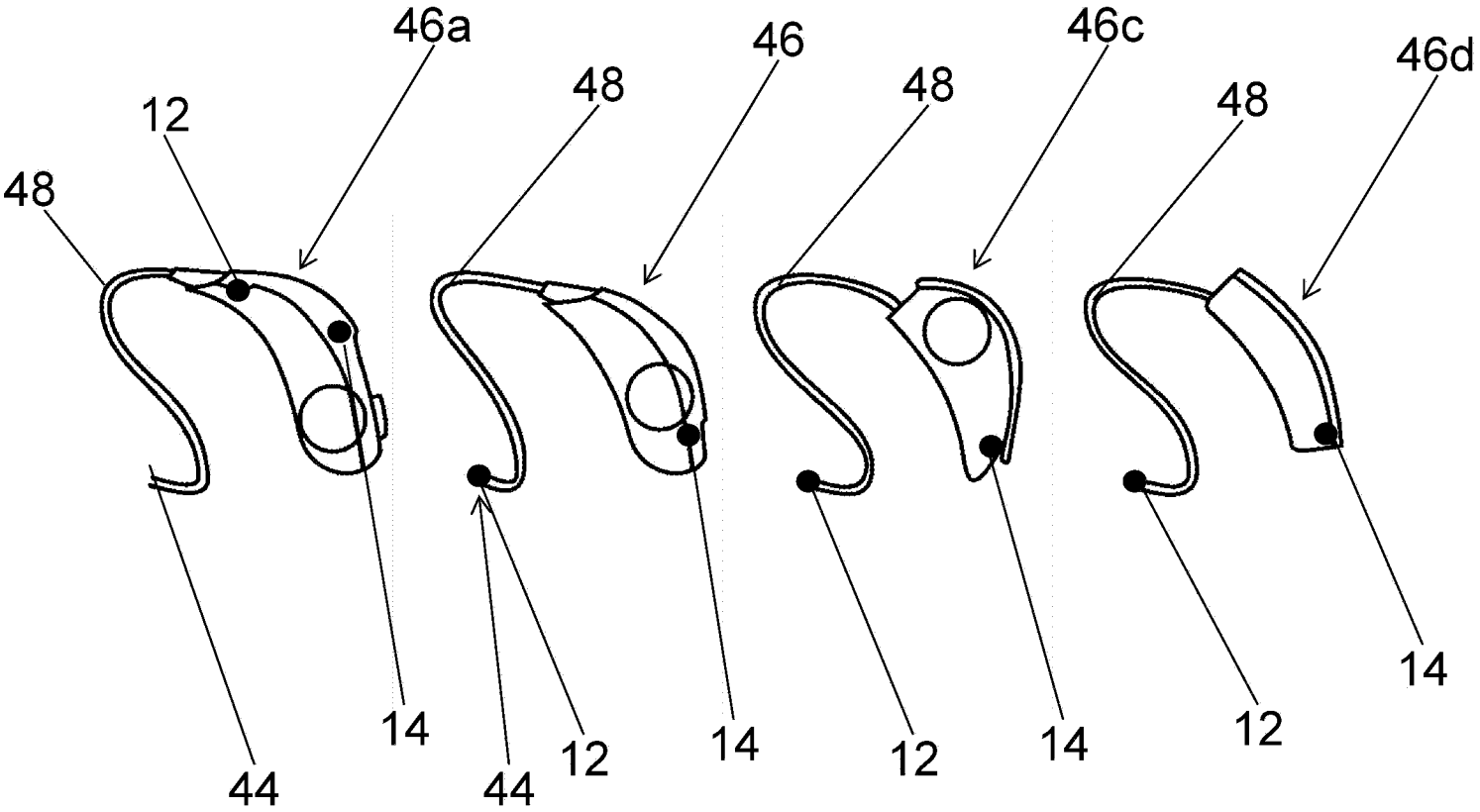
Figure 18:
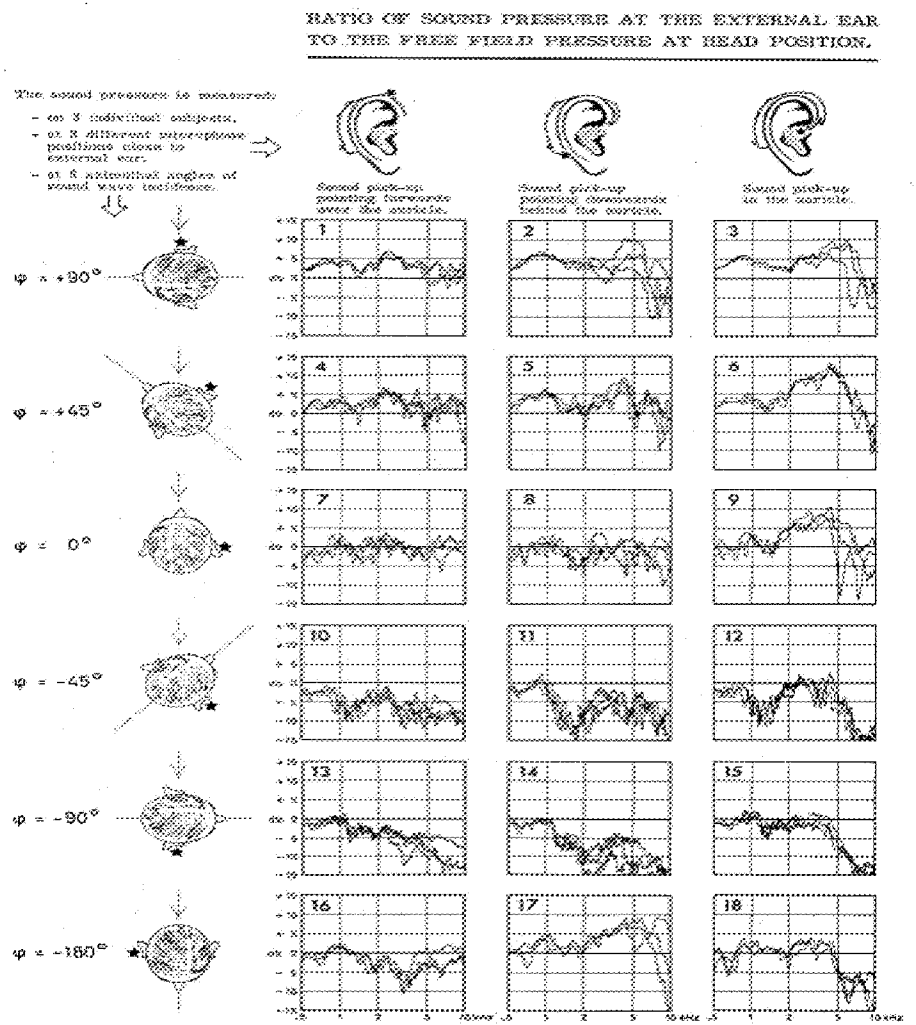
Figure 19:
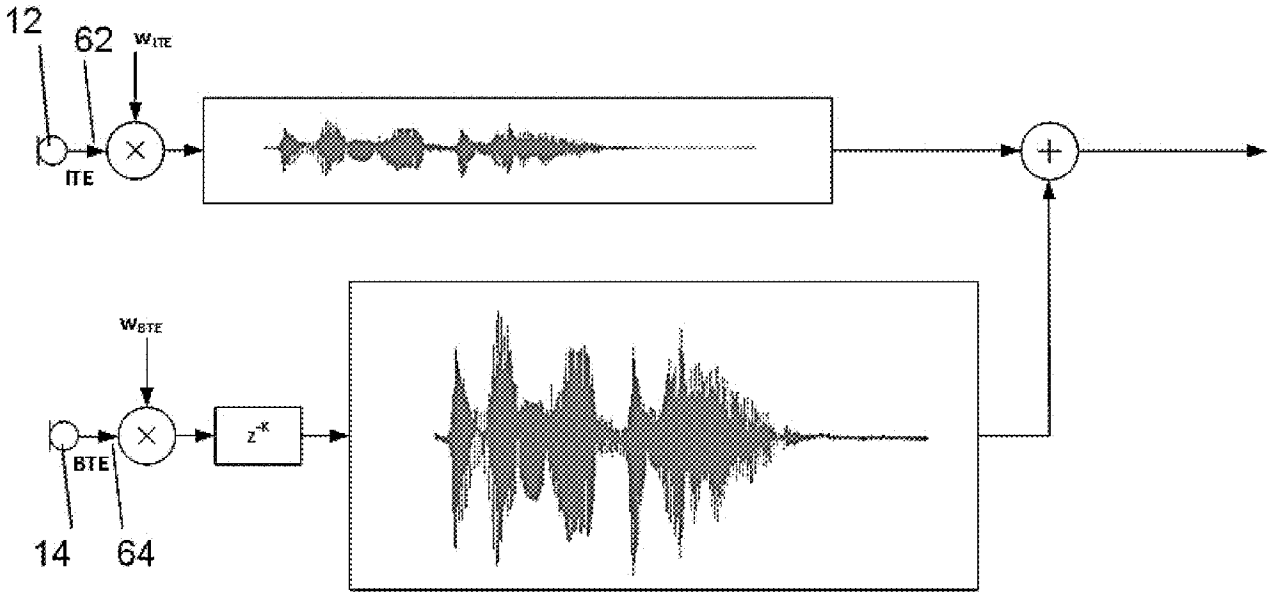

FIG. 17A shows a hearing aid with Behind-The-Ear unit and a speaker in an ear canal according to an embodiment of the disclosure, 17B shows a hearing aid with Behind-The-Ear unit and a speaker in an ear canal according to another embodiment of the disclosure, 17C shows a hearing aid with Behind-The-Ear unit and a speaker in an ear canal according to yet another embodiment of the disclosure, and 17D shows a hearing aid with Behind-The-Ear unit and a speaker in an ear canal according to yet another embodiment of the disclosure;

FIG. 18 shows a comparison of a level at three exemplary microphone locations at an ear with a BTE unit for various angles of incoming sound for the frequency range of 0.5 to 10 kHz; and FIG. 19 shows combining the first electrical acoustic signal and the second electrical acoustic signal according to an embodiment of the disclosure.

DETAILED DESCRIPTION

In the present context, a "hearing device" refers to a device, such as e.g. a hearing aid or an active ear-protection device, which is adapted to improve, augment and/or protect the hearing capability of an individual by receiving acoustic sound signals from an individual's surroundings, generating corresponding electrical acoustic signals, modifying the electrical acoustic signals and providing the modified electrical acoustic signals as output sound signals to at least one of the individual's ears. Such output sound signals may be provided into the individual's outer ears, output sound signals being transferred through the middle ear to the inner ear of the user of the hearing device.

As used herein, the singular forms "a", "an", and "the" are intended to include the plural forms as well (i.e. to have the meaning "at least one"), unless expressly stated otherwise. It will be further understood that the terms "has", "includes", "comprises", "having", "including" and/or "comprising", when used in this specification, specify the presence of stated features, integers, steps, operations, elements and/or components, but do not preclude the presence or addition of one or more other features, integers, steps, operations, elements, components and/or groups thereof. As used herein, the term "and/or" includes any and all combinations of one or more of the associated listed items.

Figure 1:
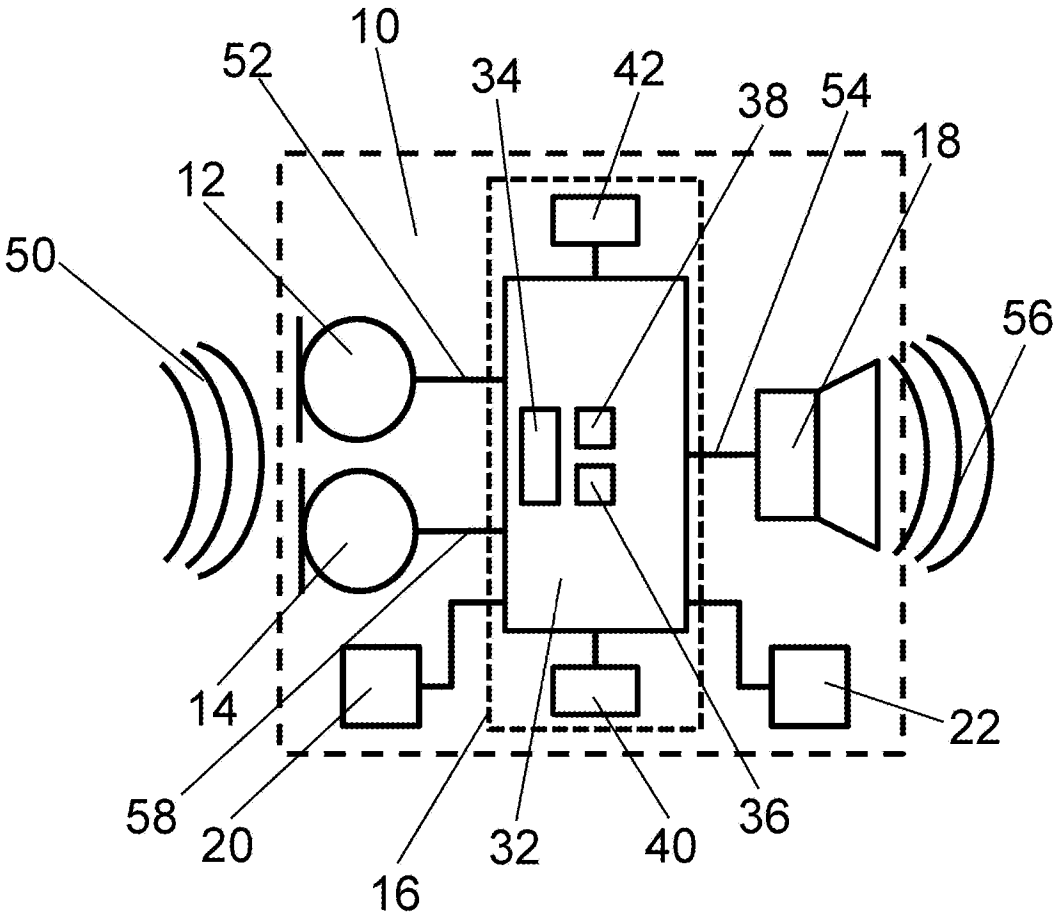

FIG. 1 shows an embodiment of a hearing aid 10 according to an embodiment of the disclosure. The hearing aid includes a first microphone 12, a second microphone 14, electric circuitry 16, a speaker 18, a user interface 20 and a battery 22. The first microphone 12 and the speaker 18 are arranged in an ear canal 24 of an ear 26 of a user 28 (see FIG. 2). The second microphone 14 is arranged behind a pinna 30 of the ear 26 of the user 28 (see FIG. 2). In this embodiment, at least one of the the microphones 12 and 14 may include microelectromechanical system (MEMS) microphones, preferably the first microphone 12 is a MEMS microphone, and the speaker is a balanced speaker allowing to build a small hearing aid 10 with good mechanical decoupling, in particular for the in-ear components of the hearing aid 10. i.e. the first microphone 12 and the speaker 18. The arrangement of the first microphone 12 in the ear canal 24 and the second microphone 14 behind the pinna 30 causes the microphones 12 and 14 to receive sound with a different level to each other, as the received sound is affected by the pinna and with a phase difference between the received sound, as there is almost always a different distance between a sound source and each of the microphones 12 and 14.

The electric circuitry 16 comprises a control unit 32, a processing unit 34, a sound generation unit 36, a memory 38, a receiver unit 40, and a transmitter unit 42. In the present embodiment, the processing unit 34, the sound generation unit 36 and the memory 38 are part of the control unit 32. The hearing aid 10 is configured to be worn at one ear 26 of the user 28. One hearing aid 10 can for example be arranged at a left ear 40 and one hearing aid can be arranged at a right ear 42 of the user 28 (see FIG. 2*a*).

Figures 2A, 2B:
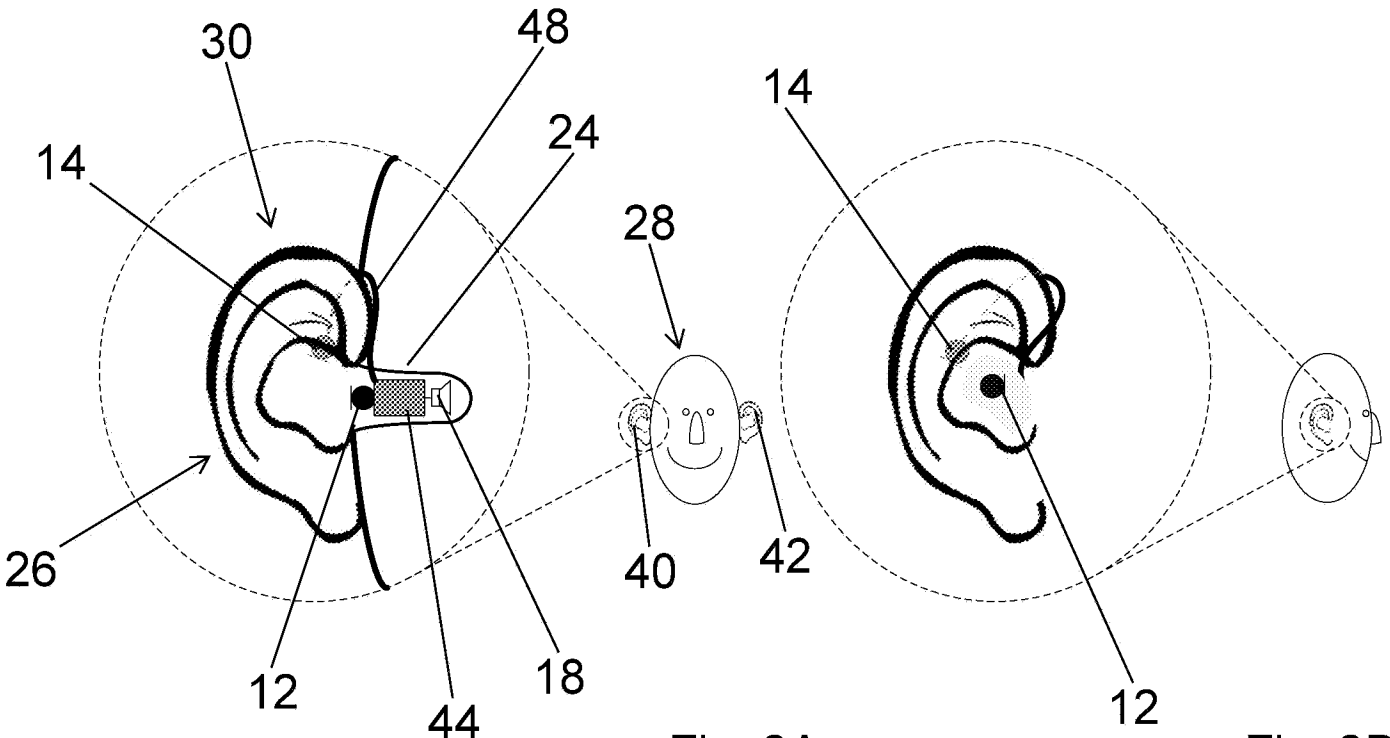

An insertion part 44, comprising the first microphone 12 and the speaker 18, of the hearing aid 10 is arranged in the ear canal 24 of the user 28 (see FIG. 2*a*). The insertion part 44 is connected to a Behind-The-Ear (BTE) unit 46 via a lead 48 (see FIG. 11B). The BTE unit 46 comprises the second microphone 14, the electric circuitry 16, the user interface 20, and the battery 22.

The hearing aid 10 can be operated in various modes of operation, which are executed by the control unit 32 and use various components of the hearing aid 10. The control unit 32 is therefore configured to execute algorithms, to apply outputs on electrical signals processed by the control unit 32, and to perform calculations, e.g., for filtering, for amplification, for signal processing, or for other functions performed by the control unit 32 or its components. The calculations performed by the control unit 32 are performed on the processing unit 34. Executing the modes of operation includes the interaction of various components of the hearing aid 10, which are controlled by algorithms executed on the control unit 32. The algorithms can also be executed on the processing unit 34.

In a hearing aid mode, the hearing aid 10 is used as a hearing aid for hearing improvement by sound amplification and filtering of sound received by the first microphone 12 or the second microphone 14. In a pinna enhancement mode the hearing aid 10 is used to improve the hearing by using sound received by the first microphone 12 and the second microphone 14 (see FIG. 5). The pinna enhancement mode in particular amplifies the effect of the users 28 own ear 26 to improve consonant audibility in noise. In a directivity enhancement mode the hearing aid 10 is used to determine a directivity pattern by using sound received by the first microphone 12 and the second microphone 14 (see FIG. 7).

The mode of operation of the hearing aid 10 can be manually selected by the user via the user interface 20 or automatically selected by the control unit 32, e.g., by receiving transmissions from an external device, receiving environment sound, or other indications that allow to determine that the user 28 is in need of a specific mode of operation. The modes of operation can also be performed in parallel, e.g., the sound received by the first microphone 12 and second microphone 14 can also be used simultaneously for the pinna enhancement mode and the directivity enhancement mode. The hearing aid 10 can also be configured to continuously perform certain modes of operation, e.g., the pinna enhancement mode and the directivity enhancement mode.

The hearing aid 10 operating in the hearing aid mode receives acoustical sound signals 50 at the first microphone 12 and/or the second microphone 14. The first microphone 12 generates first electrical acoustic signals 52 and/or the second microphone 14 generates second electrical acoustic signals 58, which are provided to the control unit 32. The processing unit 34 of the control unit 32 processes the first electrical acoustic signals 52 and/or second electrical acoustic signals 58, e.g. by spectral filtering, frequency dependent amplifying, filtering, or other typical processing of electrical acoustic signals in a hearing aid generating an electrical output acoustical signal 54. The processing of the first electrical acoustic signals 52 and/or second electrical acoustic signals 58 by the processing unit 34 may depend on various parameters, e.g., sound environment, sound source location, signal-to-noise ratio of incoming sound, mode of operation, battery level, and/or other user specific parameters and/or environment specific parameters. The electrical output acoustical signal 54 is provided to the speaker 18, which generates an acoustical output sound signal 56 corresponding to the electrical output acoustical signal 54 which stimulates the hearing of the user.

Figure 7:
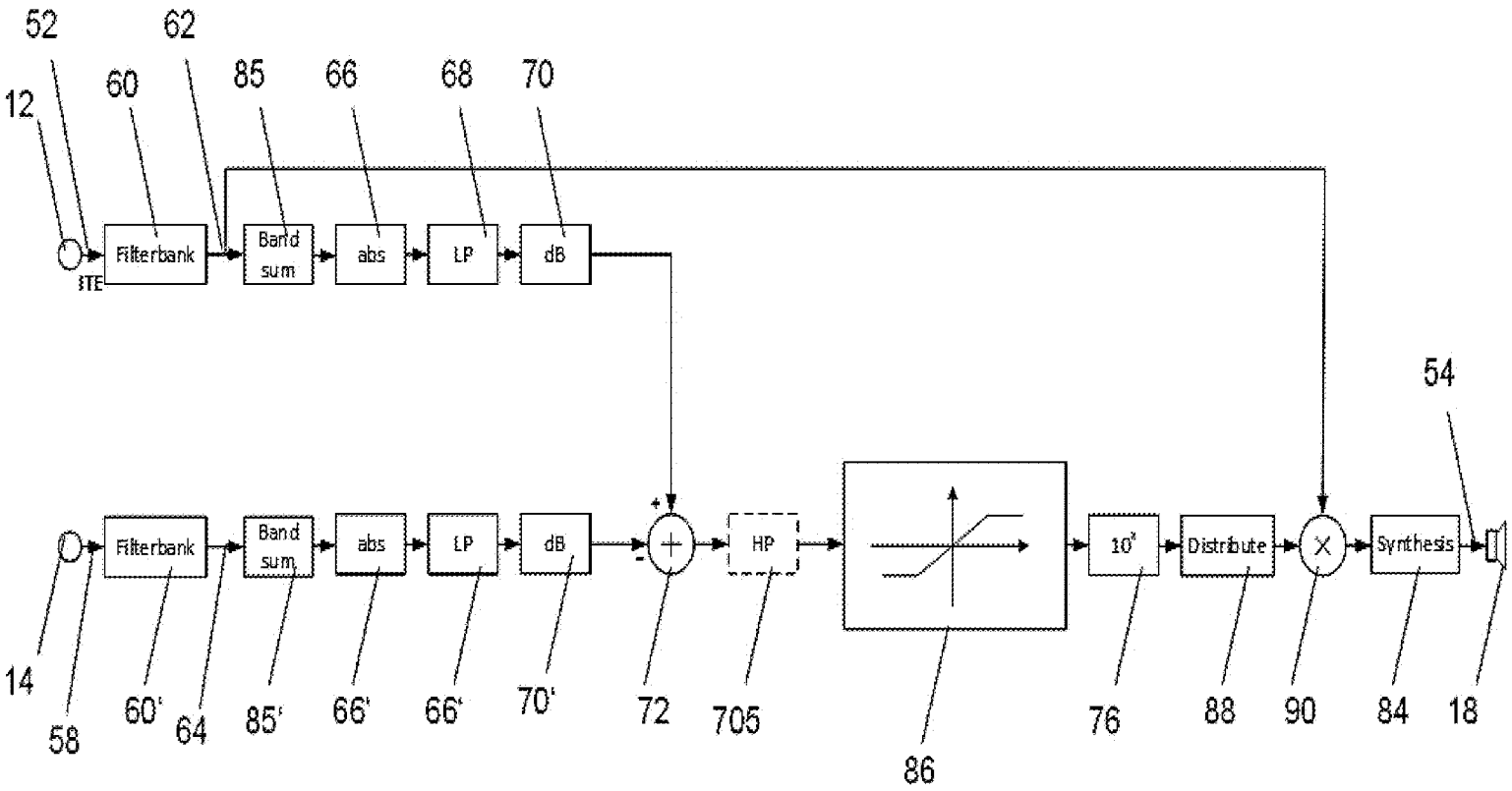
FIG. 7 shows an embodiment of a hearing aid running a directivity enhancement algorithm according to an embodiment of the disclosure.

Now referring to FIG. 7 that shows a part of the hearing aid 10 operating in the directivity enhancement mode according to an embodiment of the disclosure. The hearing aid receives acoustical sound signals 50 at the first microphone 12 and the second microphone 14. The first microphone 12 generates first electrical acoustic signals 52 and the second microphone 14 generates second electrical acoustic signals 58, which are provided to the control unit 32 (see FIG. 1). The processing unit 34 of the control unit 32 processes the first electrical acoustic signals 52 and the second electrical acoustic signals 58.

The processing unit 34 comprises a filter-bank 60, 60' of band-pass filters that filters each of the electrical acoustic signals 52 and 58 respectively into a number of frequency sub-bands, i.e., converting each of the two electrical acoustic signals 52 and 58 provided by the first microphone 12 and second microphone 14 into the frequency domain. A band sum unit 85, 85' sums the electrical acoustic signals 52 and 58 over a predetermined number of frequency channels, e.g. a frequency band of a range of 0.5 kHz, such as a frequency band from 0.5 to 1 kHz, in order to allow deriving an average level of sound.

The magnitude or magnitude squared of the respective electrical sub-band acoustic signal 62, 64 is then determined in the respective absolute value determination unit 66, 66'. The magnitudes are low-pass filtered by filters 68, 68' in order to determine In-The-Ear (ITE) levels of sound for the first electrical sub-band acoustic signals 62 and Behind-The-Ear (BTE) levels of sound for the second electrical sub-band acoustic signals 64 in the frequency band. The filters 68, 68' determine a level based on a short term basis, such as a level based on a short time interval, such as for example the last 5 ms to 40 ms or such as the last 10 ms.

The level is then converted to a domain such as a logarithmic domain or any other domain by unit 70, 70'. Then, a level difference is determined by summation unit 72. The level difference is used to determine for each unit in time and the selected frequency band if the In-The-Ear (ITE) level of the first electrical sub-band acoustic signal 62 or the Behind-The-Ear (BTE) level of the second electrical acoustic signal 64 is dominant, i.e., greater, by a level comparison unit 86. The level difference is reconverted from the logarithmic domain or any other domain to the normal domain by unit 76. Alternatively, level difference is found by division of the two level estimates.

Then the distribution unit 88 converts the level difference into a direction-dependent gain that amplifies the first electrical sub-band acoustic signal 62 when the ITE level is greater than the BTE level and attenuates the first electrical acoustic signal 62 if the BTE level is greater than the ITE level. The amount of amplification or attenuation in this embodiment depends on the determined level difference. A small level difference results in little gain while a greater level difference is converted into more gain. The gain is multiplied to the first electrical acoustic signal 52 in this embodiment by multiplication unit 90, hereby amplifying the natural directivity further. The direction-dependent gain can also be applied to the second electrical acoustic signal 58. The electrical sub-band acoustic signals are finally synthesized in the synthesize unit 84 to generate an electrical output acoustical signal 54. The electrical output acoustical signal 54 can be presented to the user 28 using speaker 18.

The gain is preferably applied to the second electrical acoustic signal 58, if too much feedback between speaker 18 and the first microphone 12 prevents the first electrical acoustic signal 52 from being used. In order to determine whether there is too much feedback the processing unit 34 can determine an average level difference over the frequency channels and select frequency channels with too large variation in level difference or too large levels for the first electrical acoustic signal 52 as feedback channels that have too much feedback.

The determination of a direction-dependent gain can also be performed only for selected frequency channels or selected frequency bands.

The units 60, 60', 66, 66', 68, 68', 70, 70', 72, 76, 84, 86, 88, and 90 can be physical units or also be algorithms performed on the processing unit 34 of the hearing aid 10.

A high pass filter 705 may be used to compensate for any constant bias present on one of the microphone signals. A HP filter having a time constant significantly greater than the LP filter (e.g. in the order of 1000 ms), would only allow fast level changes to be converted into a fluctuating gain. If the first microphone signal e.g. always is significantly greater than the second microphone signal, we would without the HP filter just obtain a constant amplification.

FIG. 18 shows a comparison of a level at three exemplary microphone locations at an ear with a BTE unit for various angles of incoming sound for the frequency range of 0.5 to 10 kHz. In one embodiment, the processing unit is configured to determine a direction-dependent gain for frequency ranging between 2000 and 5000 Hz. The processing unit is configured to apply the direction-dependent gain determined for a frequency band above 2000 Hz to frequency bands below 2000 Hz. Alternatively or additionally, the processing unit is also configured to apply the level difference determined for a frequency band below 5000 Hz to frequency bands above 5000 Hz.

Figure 5:
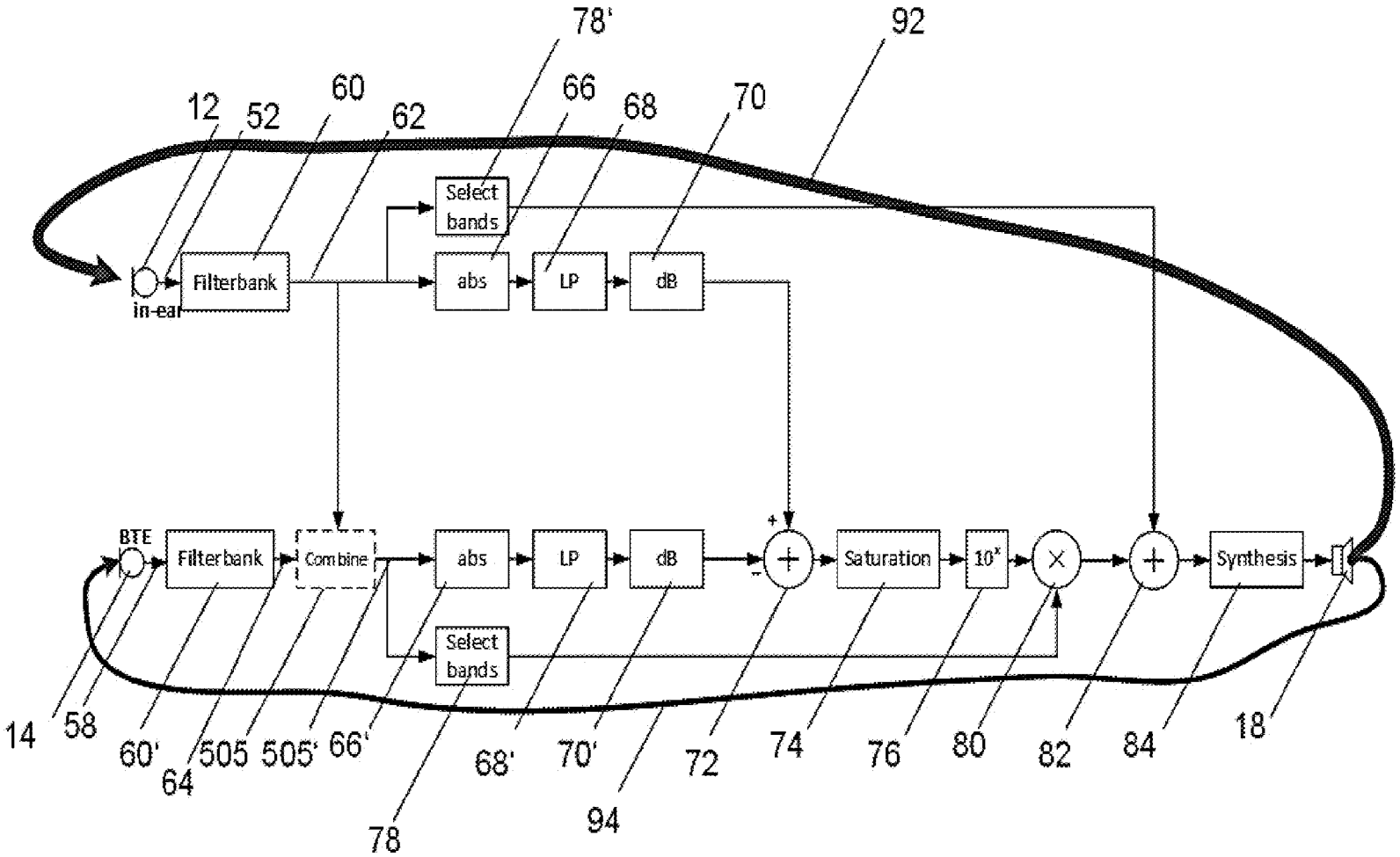
FIG. 5 shows an embodiment of a hearing aid running a pinna enhancement algorithm according to an embodiment of the disclosure.

Now referring to FIG. 5, which shows a part of the hearing aid running in a pinna enhancement mode according to an embodiment of the disclosure. The hearing aid 10 operating in the pinna enhancement mode receives acoustical sound signals 50 at the first microphone 12 and the second microphone 14. The first microphone 12 generates first electrical acoustic signals 52 and the second microphone 14 generates second electrical acoustic signals 58, which are provided to the control unit 32 (see FIG. 1). The processing unit 34 of the control unit 32 processes the first electrical acoustic signals 52 and the second electrical acoustic signals 58.

The processing unit 34 comprises a filter-bank 60, 60' which filters each of the electrical acoustic signals 52 and 58 into a number of frequency sub-bands. The filter-bank 60 processes the first electrical acoustic signals 52 into first electrical sub-band acoustic signals 62 and the filer-bank 60' processes the second electrical acoustic signals 58 into second electrical sub-band acoustic signals 64. A band summation unit, similar to the one illustrated in FIG. 7 may also be included, the unit sums the electrical acoustic signals 52 and 58 over a predetermined number of frequency channels, e.g. a frequency band of a range of 0.5 kHz, such as a frequency band from 0.5 to 1 kHz, in order to allow deriving an average level of sound.

An absolute value determination unit 66, 66' is used to determine the magnitude of the first electrical sub-band acoustic signal 52 and second electrical sub-band acoustic signal 58 respectively. In this embodiment, the processing unit 34 comprises a first order IIR filter 68, 68' which uses low-pass filtering of the magnitude of the electrical sub-band acoustic signals 62, 64 in each frequency channel to determine a level of each of the electrical sub-band acoustic signals 62 and 64 in each frequency channel. In this embodiment, the first order IIR filter has time constants in the range of 5-40 ms, preferably 10 ms. The filter could also be IIR filters possibly with different attack and release times such as an attack time between 1 and 1000 ms and a release time between 1 and 40 ms. The level can also be determined based on the magnitude squared (not shown). The level depends on the impinging acoustical sound signal 50 at the first microphone 12 and the second microphone 14, and the IIR filter 68, 68' provides a fast estimate.

In an embodiment, instead of estimating a level between the first electrical sub-band acoustic signal and second electrical sub-band acoustic signal in each frequency channel; one can envisage estimating the level between the first electrical sub-band acoustic signal and a weighted sum of the first electrical sub-band acoustic signal and the second electrical sub-band acoustic signal as indicated by an additional combine unit 505 and weighted signal 505'. In another embodiment, the level between the second electrical sub-band acoustic signal and a weighted sum of the first electrical sub-band acoustic signal and the second electrical sub-band acoustic signal may also be used. In absence of the combine unit 505; the electrical sub-band acoustic signals 62, 64 in each frequency channel are compared instead of one of the compared signal being the weighted sum of the first electrical sub-band acoustic signal and the second electrical sub-band acoustic signal.

In each frequency channel, the level of the respective first electrical sub-band acoustic signal 62 and the respective second electrical sub-band acoustic signal 64 is converted into the a domain such as a logarithmic domain or any other domain by unit 70, 70'. A summation unit 72 determines a level difference between the level of sound of the first electrical acoustic signal 52 and the level of sound of the second electrical acoustic signal 58 in each frequency channel.

In order to avoid that the level estimate of the in-ear signal being influenced by feedback events from near-field sounds which may cause that $(|A_{in\text{-}ear}|/|A_{BTE}|)>(|H_{in\text{-}ear}|/|H_{BTE}|)$, in this embodiment the level difference is limited by a level saturation unit 74 in order to ensure that $(|A_{in\text{-}ear}|/|A_{BTE}|)<(|H_{in\text{-}ear}|/|H_{BTE}|)$. The level saturation unit 74 therefore replaces the value of the level difference by a predetermined level difference threshold value, if the determined value of the level difference exceeds the predetermined level difference threshold value. The predetermined level difference threshold value can be different for different frequency channels. When the level difference is limited, the level difference between the two electrical sub-band acoustic signals 62 and 64 is only partly compensated. An external sound may cause $(|A_{in\text{-}ear}|/|A_{BTE}|)>(|H_{in\text{-}ear}|/|H_{BTE}|)$ when for example there is scratching near the first microphone 12 arranged in the ear 26 or if the second microphone 14 is blocked.

The level difference is then reconverted from the domain such as a logarithmic domain or any other domain into the normal domain by unit 76. The gain unit 80 then converts the level difference into a gain. The gain is applied to second electrical sub-band acoustic signals 64 via the gain unit 80 for feedback frequency channels selected by channel selection unit 78'. The application of the gain compensates the lack of spatial cue of the second electrical acoustic signals 58. The channel selection unit 78' is configured to select feedback frequency channels based on a feedback stability criterion or based on feedback information stored in memory 38 from, e.g., a fitting procedure. If feedback paths between the speaker 18 and each of the microphones 12 and 14 have been estimated, the selection of the feedback frequency channels can also depend on a prescribed gain, corresponding to the gain which would be applied when no feedback was present in the corresponding frequency channel, and the estimated feedback path.

Channel selection unit 78 selects non-feedback channels based on a feedback stability criterion or based on feedback information stored in memory 38 or based on the result of the channel selection unit 78'. The first electrical sub-band acoustic signals 62 are added by a summation unit 82 to the second electrical sub-band acoustic signals 64 compensated by the gain, which are then synthesized into an electrical output acoustical signal 54 by a synthesize unit 84 which can be converted to an acoustical output sound signal 56 (see FIG. 1) by the speaker 18.

Whenever the feedback path 92 at the first microphone 12 allows to apply the prescribed gain to the first electrical sub-band acoustic signal 62 in a specific frequency channel, the first electrical sub-band acoustic signal 62 is used. However, whenever the feedback path 92 at the first microphone 12 does not allow the first electrical sub-band acoustic signal 62 to be used, the second electrical sub-band acoustic signal 64 compensated for the level difference is used in said specific frequency channel. The second electrical sub-band acoustic signal 64 can also be only used for a specific frequency channel, when low input levels are estimated in that specific frequency channel.

The units 60, 66, 66', 68, 68', 70, 70', 72, 74, 76, 80, 82, and 84 can be physical units or also be algorithms performed on the processing unit 34 of the hearing aid 10.

The gain function determined by the pinna enhancement mode and the directivity enhancement mode can also depend on the overall level of the electrical acoustic signals 52 and 58, for example, the enhancement may only be required in loud sound environments.

The memory 38 is used to store data, e.g., predetermined output test sounds, predetermined electrical acoustic signals, predetermined time delays, algorithms, operation mode instructions, or other data, e.g., used for the processing of electrical acoustic signals.

The receiver unit 40 and the transmitter unit 42 allow the hearing aid 10 to connect to one or more external devices, e.g., a second hearing aid, a mobile phone, an alarm, a personal computer or other devices (not shown). The receiver unit 40 and transmitter unit 42 receive and/or transmit, i.e., exchange, data with the external devices. The hearing aid 10 can for example exchange predetermined output test sounds, predetermined electrical acoustic signals, predetermined time delays, algorithms, operation mode instructions, software updates, or other data used, e.g., for operating the hearing aid 10. The receiver unit 40 and transmitter unit 42 can also be combined in a transceiver unit, e.g., a Bluetooth-transceiver, a wireless transceiver, or the like. The receiver unit 40 and the transmitter unit 42 can also be connected with a connector for a wire, a connector for a cable or a connector for a similar line to connect an external device to the hearing aid 10.

Referring to FIG. 2 that shows two possible configurations of the first microphone 12, the second microphone 14 and speaker 18 of hearing aid 10. The first microphone 12 and the speaker 18 are arranged in the insertion part 44 which is arranged in the ear canal 24 (see FIG. 2*a*) or the ear 26 (see FIG. 2*b*) of the user 28. The second microphone 14 is arranged in the BTE unit 46 (see FIG. 11B) which is arranged behind the pinna 30. The second microphone 14 is located further away from the ear canal 24 than the first microphone 12. When presenting the sounds received at the two microphones 12 and 14 worn by the user 28, sound recorded by the first microphone 12 in the ear canal 24 or ear 26 will be perceived as more natural compared to sound picked up by the second microphone 14 behind the pinna 30, as the pinna enhances the auditory perception of the sound.

Figure 3:
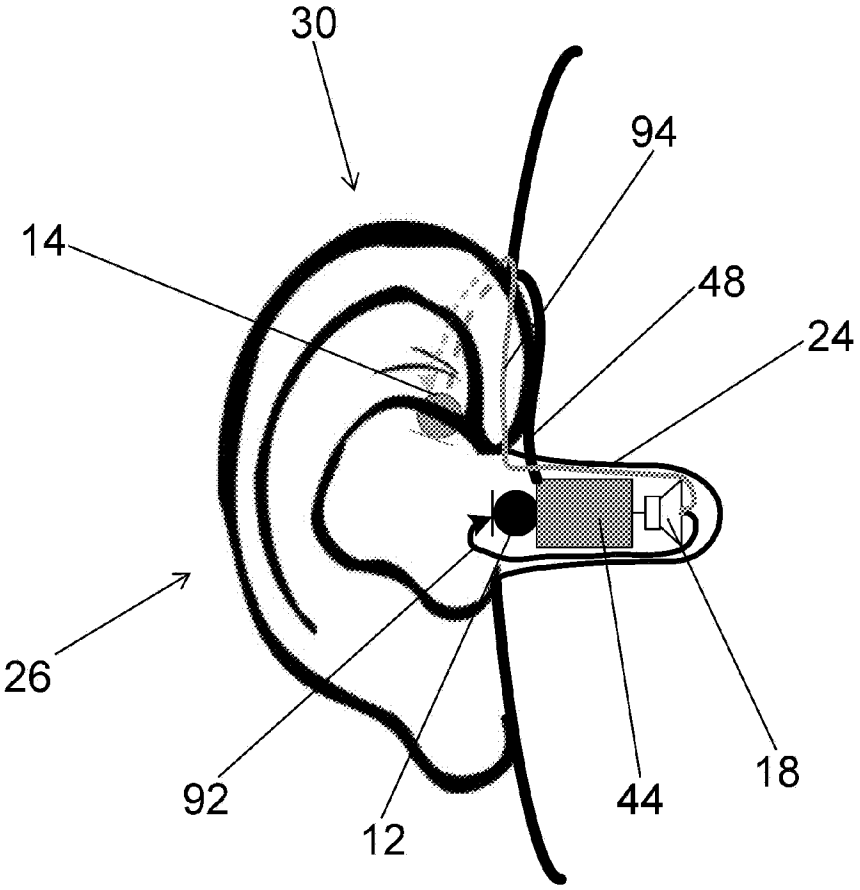
FIG. 3 shows a schematic illustration of the hearing aid of FIG. 2*a* with feedback paths between microphones and speaker according to an embodiment of the disclosure.

FIG. 3 shows feedback 92 from the speaker 18 to the first microphone 12 and feedback 94 from the speaker 18 to the second microphone 14. The feedback 92 is expected to be more dominant at the first microphone 12 compared to the feedback 94 at the second microphone 14. Therefore, the feedback path 92 from the speaker 18 to the first microphone 12 arranged In-The-Ear (ITE) is greater than the feedback path 94 between the speaker 18 and the second microphone 14 arranged Behind-The-Ear (BTE). Thus, in general more gain can be applied to a hearing aid 10, where the microphone is placed further away from the signal presented by the speaker 18. On the other hand, the sound is perceived as more natural when it is picked up by the first microphone 12, which is as close to the eardrum in the ear canal 24 as possible.

Therefore, in an embodiment, whenever the feedback path 92 at the first microphone 12 allows for the prescribed gain, the first microphone 12 is preferably used. However, whenever the feedback path 92 at the first microphone 12 does not allow the first microphone 12 to be used, the second microphone 14 is used with level difference compensation.

In an embodiment, instead of estimating a level between the first electrical sub-band acoustic signal and second electrical sub-band acoustic signal in each frequency channel; one can envisage estimating the level between the first electrical sub-band acoustic signal and a weighted sum of the first electrical sub-band acoustic signal and the second electrical sub-band acoustic signal. In another embodiment, the level between the second electrical sub-band acoustic signal and a weighted sum of the first electrical sub-band acoustic signal and the second electrical sub-band acoustic signal may also be used.

In an embodiment, a selection criterion for binaural fitting may also be provided, where the same microphone is chosen on both ears. For example, the BTE (or a weighted sum of the microphones) microphone is selected in a specific frequency band on the left hearing instrument due to feedback problems, the same configuration may be selected on the right hearing instrument, even though there might not be any feedback issues in this particular frequency band on the right hearing instrument. Because of similar configurations on both left and right hearing instruments, localization cues are better maintained.

Figure 4:
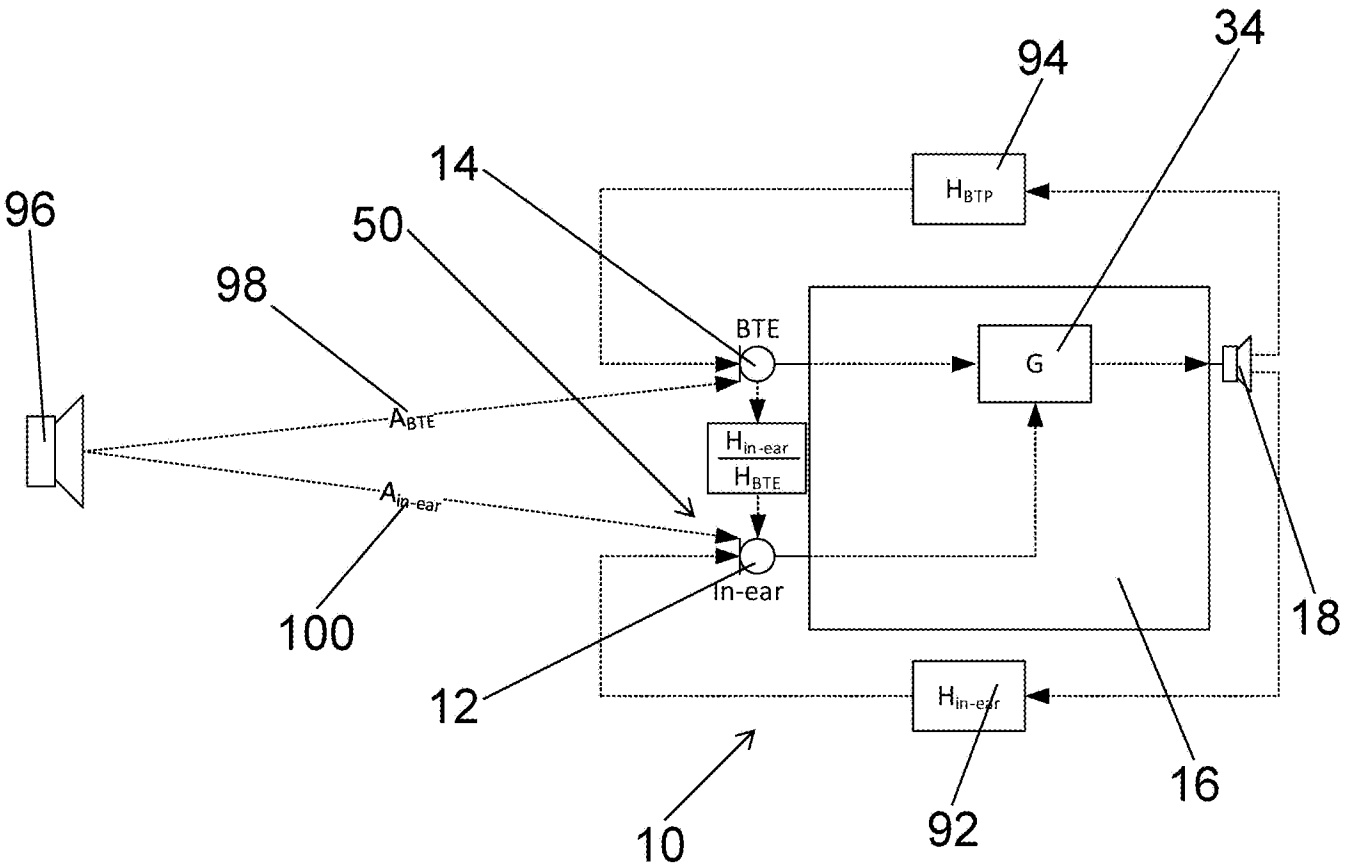
FIG. 4 shows a schematic illustration of an embodiment of a hearing aid with feedback paths and transfer paths between an external sound source and microphones according to an embodiment of the disclosure.

FIG. 4 shows a schematic illustration of an embodiment of hearing aid 10 with an external sound source 96 generating an acoustical sound signal 50 without feedback. The two feedback path transfer functions which represent the change of the acoustical sound signal from the speaker 18 to each of the two microphones 12 and 14 are denoted $H_{BTE}$ corresponding to feedback path 94 and $H_{in\text{-}ear}$ corresponding to feedback path 92. The relative feedback path transfer function between the two microphones 12 and 14 is given by the ratio between $H_{BTE}$ and $H_{in\text{-}ear}$. Similarly, the transfer functions from the external sound source 96 to each of the microphones 12 and 14 are denoted $A_{BTE}$ 98 and $A_{in\text{-}ear}$ 100. When the external sound source 96 is far from the ears 26 of the user 28, it is expected that the ratio between the transfer functions $A_{BTE}$ 98 and $A_{in\text{-}ear}$ 100 is smaller than the ratio between the feedback path transfer functions $H_{BTE}$ 94 and $H_{in\text{-}ear}$ 92 because the feedback path transfer functions are present in the near field, where the relative difference in the distance between the microphones 12 and 14 to the speaker 18 is greater than the relative difference in the distance between the microphones 12 and 14 to the sound source 96, i.e., $(|A_{in\text{-}ear}|/|A_{BTE}|)<(|H_{in\text{-}ear}|/|H_{BTE}|)$. The ratio between the feedback paths 92, 94 is expected to be more stationary than the ratio between the transfer functions 98, 100 between the external source 96, because an external sound source 96 may come from any direction, while the microphone 12 and 14 to speaker 18 configuration shows only small variations due to the positioning of the microphones 12 and 14 at the ear 26. Whenever $(|A_{in\text{-}ear}|/|A_{BTE}|)<(|H_{in\text{-}ear}|/|H_{BTE}|)$ and the external sound source 96 is the main contribution to the acoustical sound signal 50 received by the microphones 12 and 14, it might be preferable to listen to the acoustical sound signal 50 picked up by the second microphone 14 and compensate the second electrical acoustic signal 58 generated by the second microphone 14 by the estimated level difference between the second electrical acoustic signal 58 and the first electrical acoustic signal 52. For example, if $(|A_{in\text{-}ear}|/|A_{BTE}|)<10(|H_{in\text{-}ear}|/|H_{BTE}|)$, and $|A_{in\text{-}ear}|=2|A_{BTE}|$, 5 times more amplification can be applied to the second electrical acoustic signal 58 compared to the first electrical acoustic signal 52—even after the second electrical acoustic signal 58 was compensated for the level difference between the first electrical acoustic signal 52 and the second electrical acoustic signal 58. Thus, the output sound 56 presented to the user may include the second electrical acoustic signal 58 that is processed and compensated for spatial cue by inclusion of the level difference, as obtained by measuring the fast varying level difference between the sound signals received at the first microphone 12 and the second microphone 14.

Figure 6:
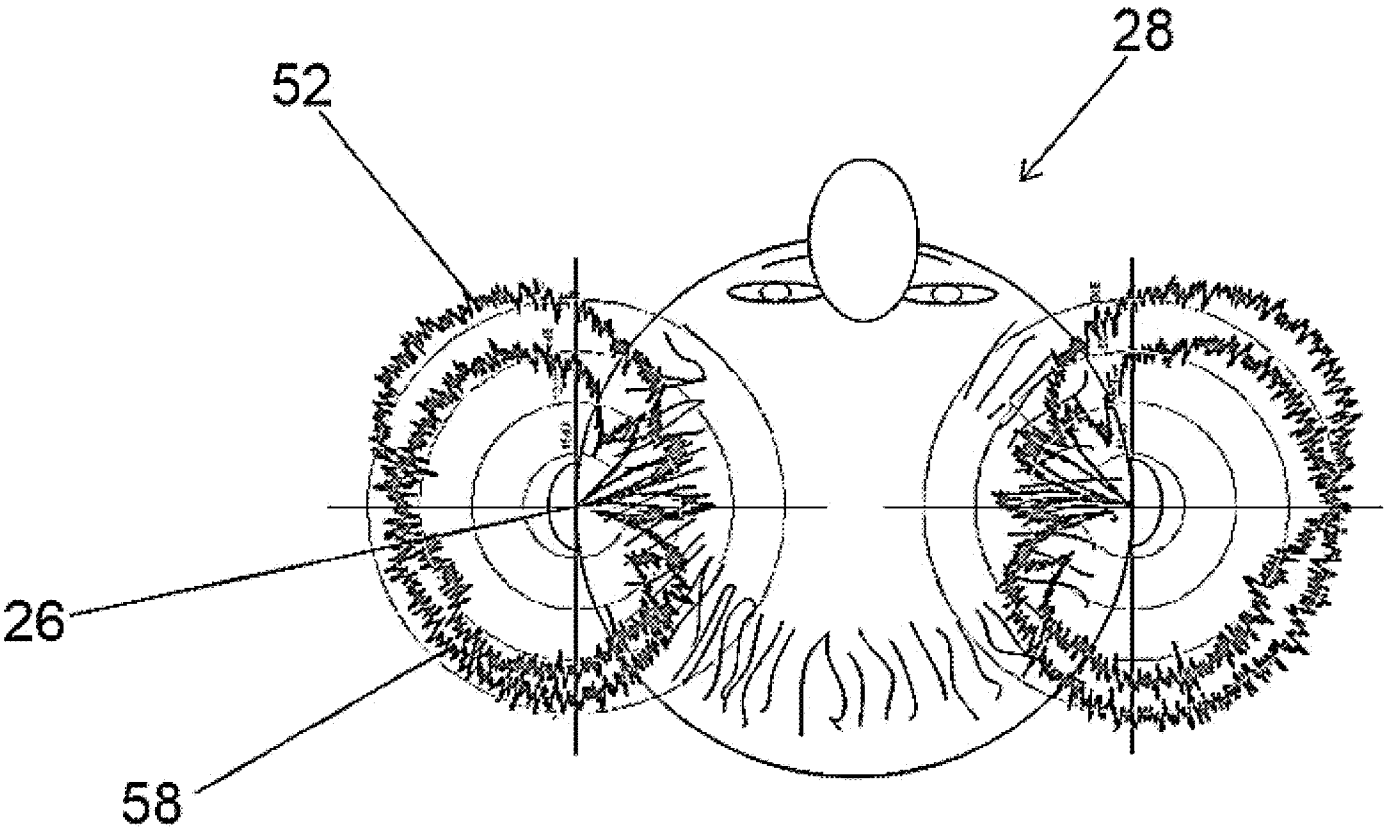
FIG. 6 shows an exemplary directivity pattern of a microphone arranged in the ear of a user and a microphone arranged behind the ear of the user for a frequency band around 3.5 kHz.

FIG. 6 shows a directional response, also called directivity pattern in this text, of the first microphone 12 in the ear (ITE) and the second microphone 14 behind the ear (BTE) for a frequency band around 3.5 kHz. The placement of the second microphone 14 tends to amplify sound signals more from the back compared to the front, while the placement of the first microphone 12 tends to have more amplification towards acoustical sound signals impinging from the front direction compared to the back direction.

Figure 8:
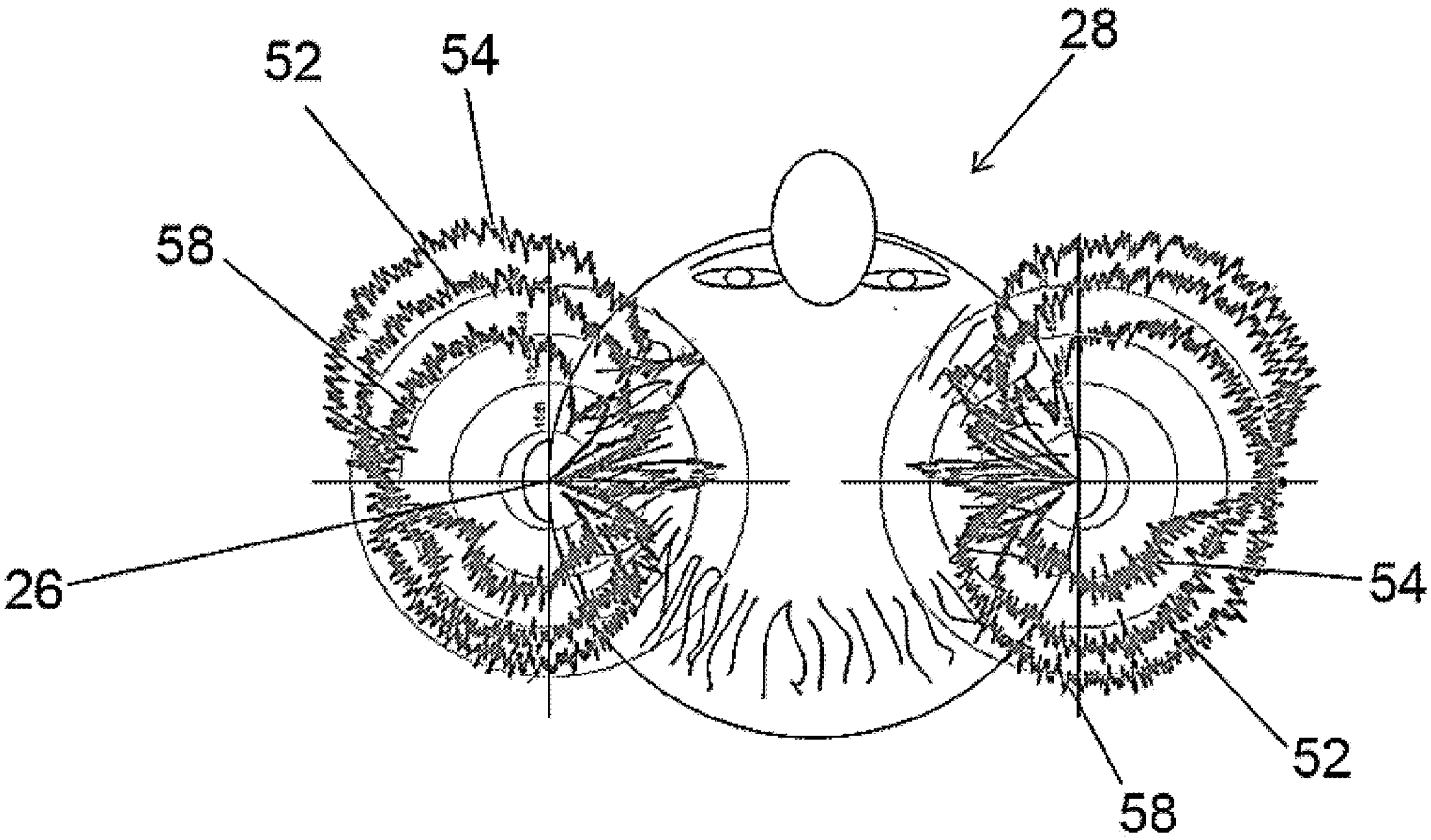
FIG. 8 shows an exemplary directivity pattern of a microphone arranged in the ear of a user, a microphone arranged behind the ear of the user, and an enhanced signal generated from using both microphones for a frequency band around 3.5 kHz according to an embodiment of the disclosure.

FIG. 8 shows a directivity pattern resulting from a direction dependent-gain according to an embodiment of the disclosure. The direction dependent-gain is applied to the first electrical acoustic signal 52 of the first microphone 12, which generates the electrical output acoustical signal 54 that corresponds to the first electrical acoustic signal 52 processed by a hearing aid 10 performing the directivity enhancement mode. The level difference between the first microphone 12 arranged in the ear (ITE) and the second microphone 14 arranged behind the ear (BTE) can be turned into a gain function which enhances the impinging acoustical sound signal 50 from the directions, where the level of the first electrical acoustic signal 52 is greater than the level of the second electrical acoustic signal 58 and attenuates the acoustical sound signal 50 impinging from directions where the level of the second microphone 14 is greater than the level of the first microphone 12.

Figure 9:
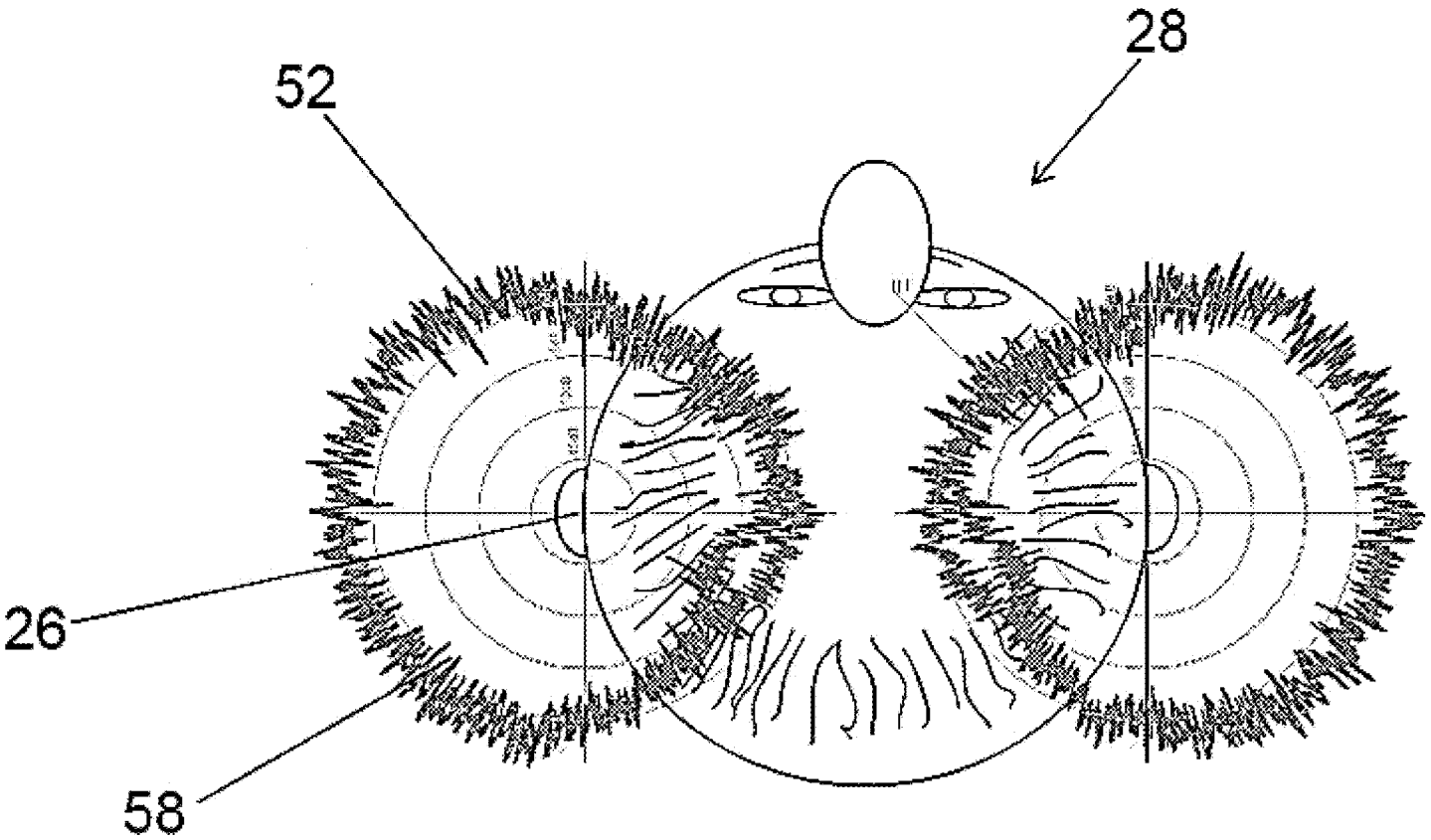
FIG. 9 shows an exemplary directivity pattern of a microphone arranged in the ear of a user and a microphone arranged behind the ear of the user for a frequency band around 1000 Hz according to an embodiment of the disclosure.

In some frequency bands, the level difference between the first microphone 12 arranged in the ear 26 and the second microphone 14 arranged behind the ear 26 is greater than the level difference in other frequency bands, as can be seen by comparison of FIG. 8 and FIG. 9.

FIG. 9 shows an exemplary directional response, i.e. directivity pattern, of a first microphone 12 arranged in the ear (ITE) and a second microphone 14 arranged behind the ear (BTE) for a frequency band around 1 kHz. In this frequency band, there is only little difference between the ITE and the BTE microphone placements, both the directivity patterns generated by the first electrical acoustic signal 52 and the second electrical acoustic signal 58 show an almost identical pattern. This follows, as the wavelength at 1 kHz is greater than the size of the pinna. Therefore, the pinna becomes insignificant and this results in almost no direction-dependent level difference between the electrical acoustic signals 52 and 58 generated by the first microphone 12 and the second microphone 14. A level difference based on this band does therefore need not be converted into a gain. In frequency bands where the level difference becomes unreliable, a level difference determined for a neighboring frequency band, which is more reliable is used to determine a gain. Alternatively also no gain at all can be applied to the specific frequency channel. For example an ITE-BTE level difference in a frequency band between 2 kHz and 3 kHz can be applied to a frequency band in the frequency range of 1.5 to 2 kHz. Furthermore a level difference in a frequency band around 5 kHz can be applied to frequency bands above 5 kHz.

Furthermore, the frequency response of the first microphone 12 and the second microphone 14 may be different to each other. An offset between the levels of the electrical acoustic signals 52 and 58 generated by the microphones 12 and 14 can be removed by high-pass filtering the level difference before it is converted into a gain (not shown).

Now referring to FIG. 19 that shows combining the first electrical acoustic signal and the second electrical acoustic signal according to an embodiment of the disclosure. One electrical acoustic signal is delayed compared to the another electrical acoustic signal for example, the second electrical acoustic signal 64 is delayed compared to the first electrical acoustic signal 62. The delay could e.g. be in the range of 1-10 ms. A weight $W_{ITE}$, $W_{BTE}$ may be applied individually to both the first and the second electrical signal. The ratio of the weights may depend on the estimated feedback paths. By delaying the second microphone signal compared to the first microphone signal, a higher gain may be obtained by applying most of the weight of the BTE microphone signal, while maintaining correct spatial perception by allowing the first wavefront of the mixed sound to origin from the ITE microphone. The delay between the first and the second microphones on the two hearing instruments being used for the left ear and the right ear set up in a binaural system could be different. Hereby the perceived coloration due to the comb-filter effect is reduced as the notches on the two instruments will occur at different frequencies.

Figure 10B:
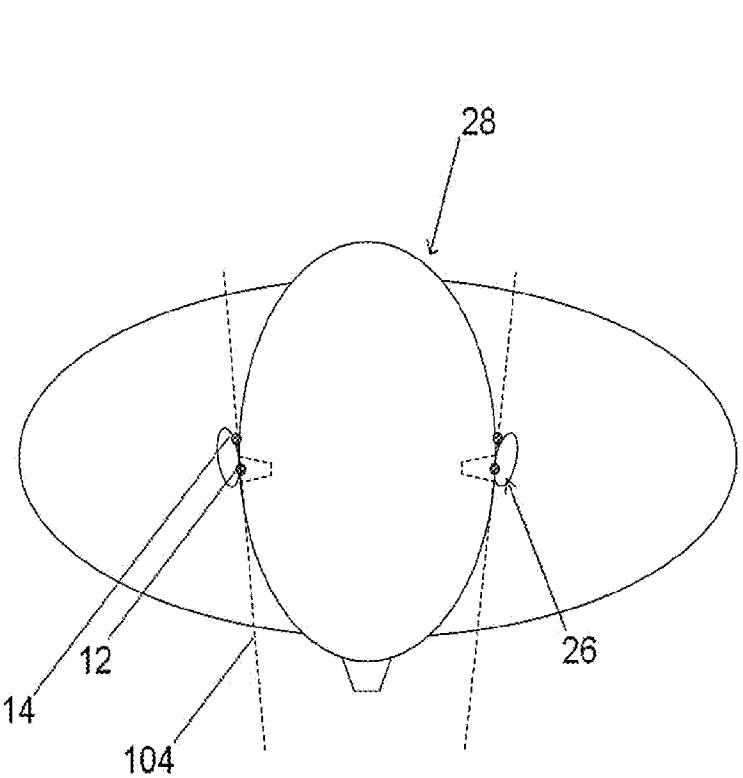
FIG. 10B shows a hearing aid with the microphone arraybeing parallel to the front-back axis of the head, according to an embodiment of the disclosure.
Figure 10A:
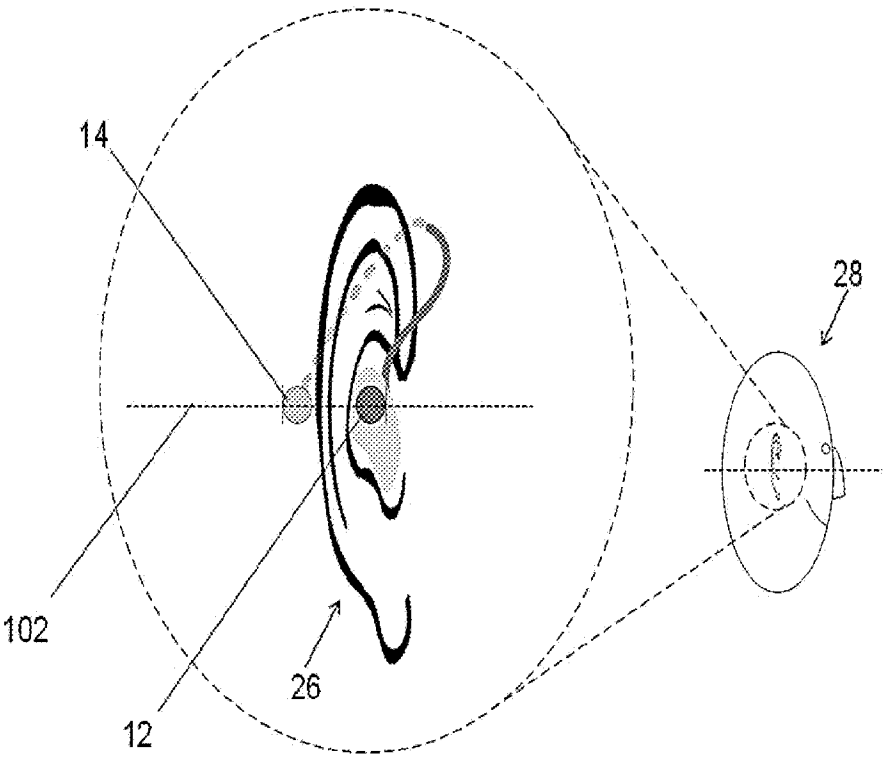
FIG. 10A shows a hearing aid with a horizontally arranged microphone array of a first microphone arranged in an ear and a second microphone arranged behind the ear according to an embodiment.

FIG. 10 shows a microphone array comprising the first microphone 12 arranged in the ear and the second microphone 14 arranged behind the pinna. The two microphones 12 and 14 are close to being in the same horizontal plane 102. When the two microphones 12 and 14 and the speaker 18 are in the same horizontal plane 102, and the microphone array is close to parallel to the head, the two feedback path estimates 92, 94 can be used to estimate the distance between the two microphones 12 and 14 as seen from the front direction because the receiver is very close to one of the microphones compared to the distance to the other microphone, which means that the delay between the microphones corresponds to the delay difference between the receiver to each of the microphones or by calculating the cross correlation of the feedback path estimates 92, 94 using the processing unit 34. The microphone distance is used to select an optimized directional filter for the directionality in the lower frequencies. The hearing aid 10 can perform the distance measurement and application of an optimized directional filter as a low frequency (LF) directivity enhancement mode running as a low frequency directivity enhancement algorithm on the processing unit 34. The low frequency (LF) directivity enhancement mode corresponds to beamforming. By measuring the feedback paths, it is possible to compensate for the fact that the actual microphone distance is unknown in this embodiment. The measure of the feedback path may be performed everytime the hearing instrument is mounted on the ear, allowing to take hearing instrument mounting variation into account. Alternatively or additionally, the delay may also be determined by measuring the distance and manually typing the measured distance and/or the delay may be determined from a picture captured of the ear with the hearing instrument mounted. In standard hearing aids the actual microphone distance is generally known.

The directivity enhancement method mainly enhances the directivity patterns at higher frequencies, i.e. in the following called high frequency (HF) directivity enhancement mode, which means that especially the consonant part of speech will be enhanced. With microphones 12 and 14 placed on each side of the pinna 30 a microphone array which is close to a horizontal array in a horizontal plane 102 can be build (see FIG. 11). In that case, the microphone distance is greater compared to the usual microphone distance in a two-microphone hearing device having both microphones in a BTE unit 46*a* (see FIG. 11A). A greater microphone distance, however, will due to spatial aliasing as well as microphone level differences prevent a differential beamformer from working optimally at the higher frequencies. However, if the microphone distance is known or estimated good directionality in the lower frequencies can be achieved by a delay and subtract beamformer. In particular using larger distance between the two microphones 12 and 14, e.g., a microphone distance of 30 mm instead of say 9 mm, allows to improve the directivity effect at lower frequencies. The beamformer can be adaptive and perform an individual beamforming on each frequency band. The beamformer can be combined with the microphone level difference based pinna enhancement algorithm at higher frequencies. Hereby a signal-to-noise (SNR) improvement is obtained at lower frequencies due to beamforming. At higher frequencies, a natural directivity is obtained by listening to the first microphone 12 arranged in the ear. Further directivity enhancement can be obtained by enhancing the first electrical acoustic signal 52 based on the level difference between the two microphones 12 and 14, i.e. performing the directivity enhancement mode. In some frequency regions both enhancement from directivity, i.e. beamforming, as well as microphone level difference based enhancements, i.e. pinna enhancement mode and directivity enhancement mode can be obtained.

Additionally and alternatively, the microphone array including the first input sound transducer and the second input sound transducer are not only in the same horizontal plane but the microphone array is parallel to the front-back axis 104 (see FIG. 10B) of the head. This would be the case when the ITE microphone is positioned at the entrance of the ear canal.

Figures 11A, 11B:
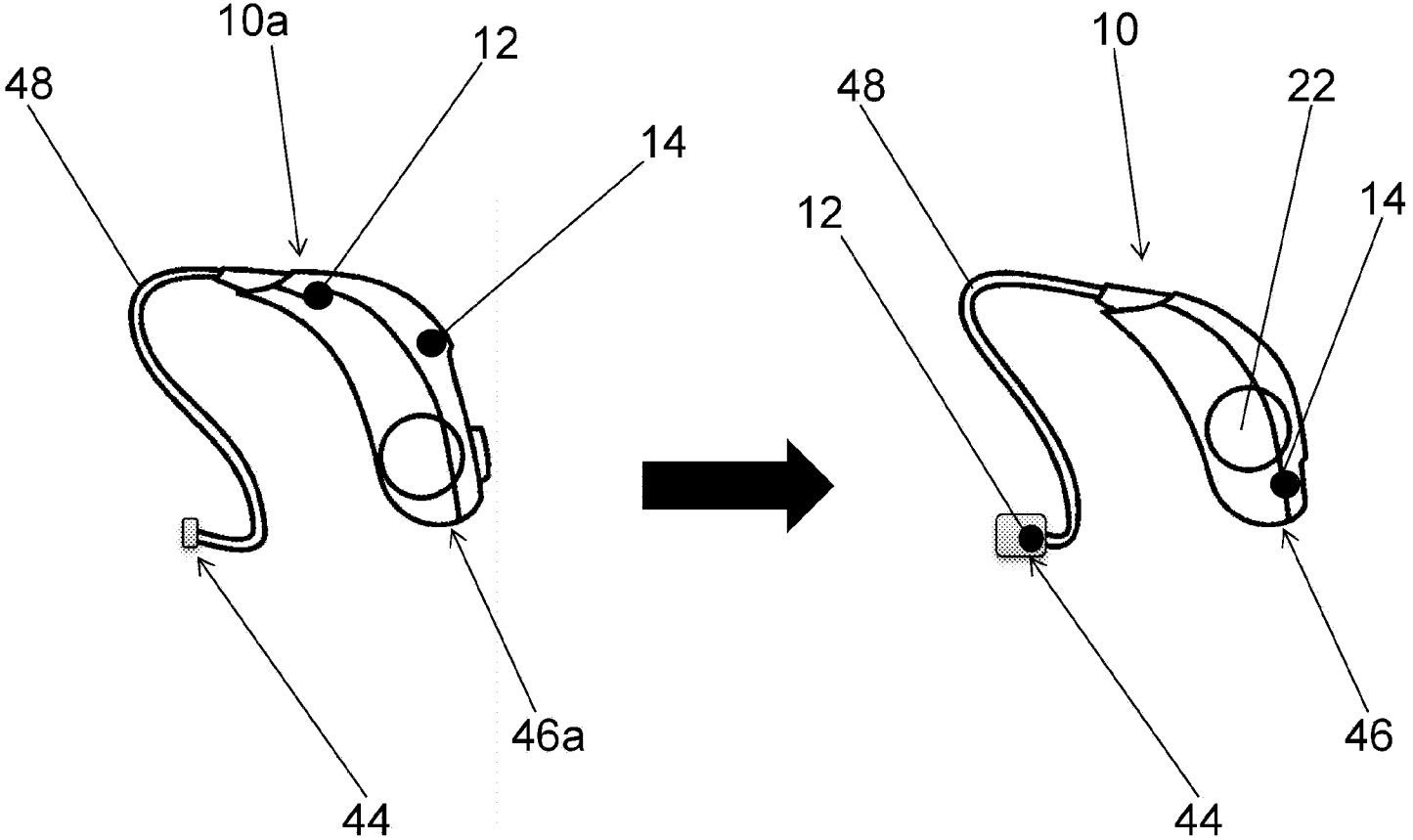
FIG. 11A shows a prior art hearing aid with two microphones in a BTE unit and FIG. 11B shows an embodiment of a hearing aid with a first microphone arranged in an ear canal and a second microphone arranged in a BTE unit behind an ear according to an embodiment of the disclosure.

FIG. 11*a* shows a hearing aid 10*a* of prior art in Receiver-In-The-Ear (RITE) style with two microphones 12 and 14 arranged in the BTE unit 46*a*. The BTE unit 46*a* is connected to an insertion part 44 via a lead 48. The insertion part 44 is inserted in an ear canal 24 of a user 28. Speaker 18, also called receiver, is located in the insertion part 44. According to an embodiment of the disclosure, FIG. 11*b* shows the hearing aid 10 in RITE style with a first microphone 12 in the ear canal 24 of the user 28 and a second microphone 14 at the back of the BTE unit 46. The first microphone 12 and a speaker 18 are arranged in an insertion part 44. The insertion part 44 is connected to the BTE unit 46 via a lead 48. As described according to various embodiments, the arrangement of the two microphones 12 and 14 allows for an improved hearing.

Figure 12:
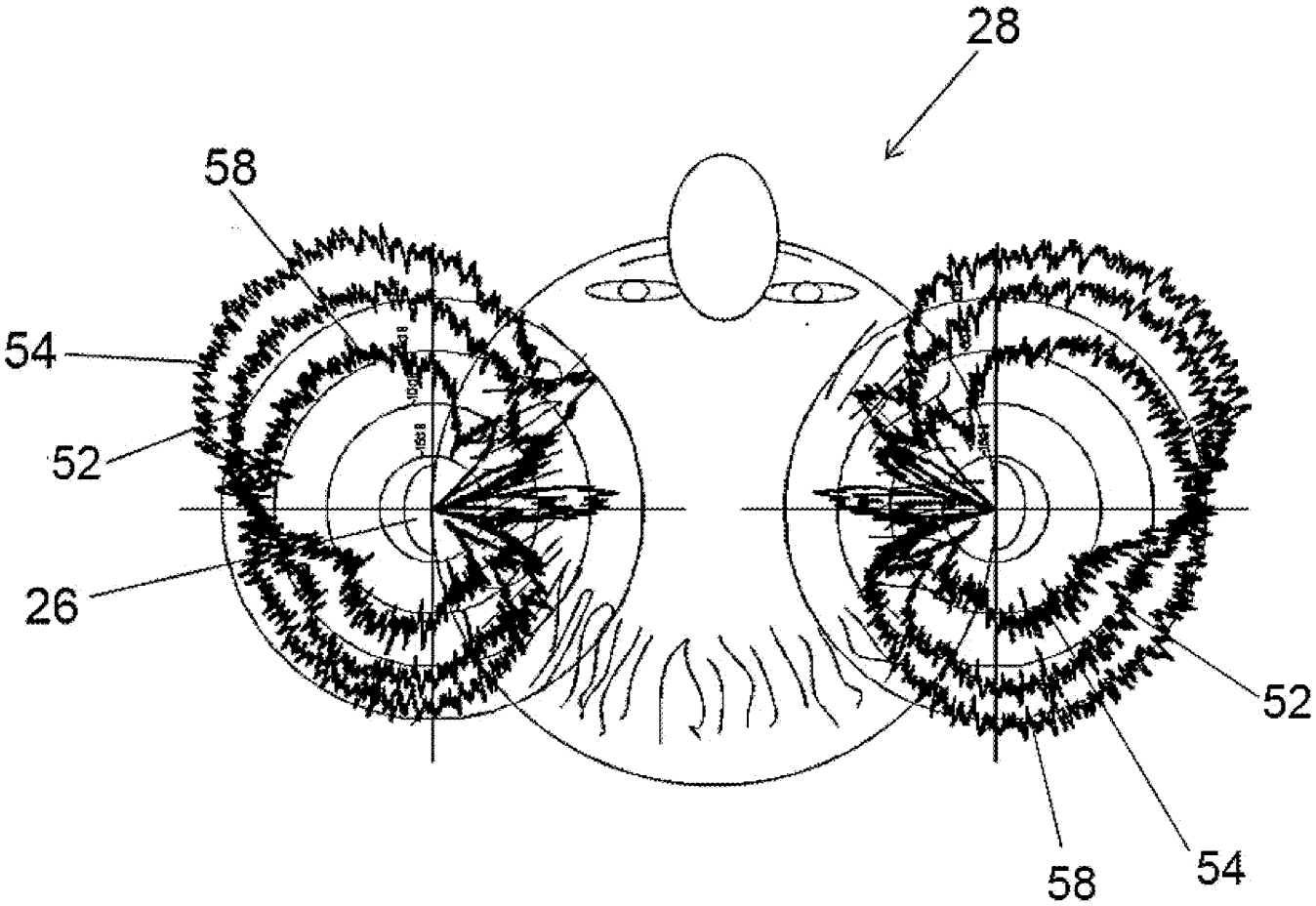
FIG. 12 shows an exemplary directivity pattern of a microphone arranged in the ear of a user, a microphone arranged behind the ear of the user, and an enhanced signal generated from using both microphones for a frequency band around 3.5 kHz according to an embodiment of the disclosure.

FIG. 12 shows an exemplary directivity pattern of a microphone arranged in the ear of a user, a microphone arranged behind the ear of the user, and an enhanced signal generated from using both microphones for a frequency band around 3.5 kHz according to an embodiment of the disclosure. Using the hearing device 10 of an embodiment of the disclosure, the difference between level of the directivity patterns for the first electrical acoustic signal 52 at the first microphone (12, see FIG. 1) and level of the directivity pattern for the second electrical acoustic signal 58 at the second microphone (14, see FIG. 1) is turned into a gain function as represented by the directivity pattern of the electrical output acoustical signal 54. Thus, the hearing aid 10 comprising the first microphone 12 in the ear canal 24 and the second microphone 12 behind the pinna 30 enhances the impinging signal from directions where the level of the first electrical acoustic signal 52 is greater than the level of the second electrical acoustic signal 58 and to attenuate the impinging signal where the level of the first electrical acoustic signal 52 is lower than the level of the second electrical acoustic signal 58, thus allowing for directivity enhancement.

Figure 13:
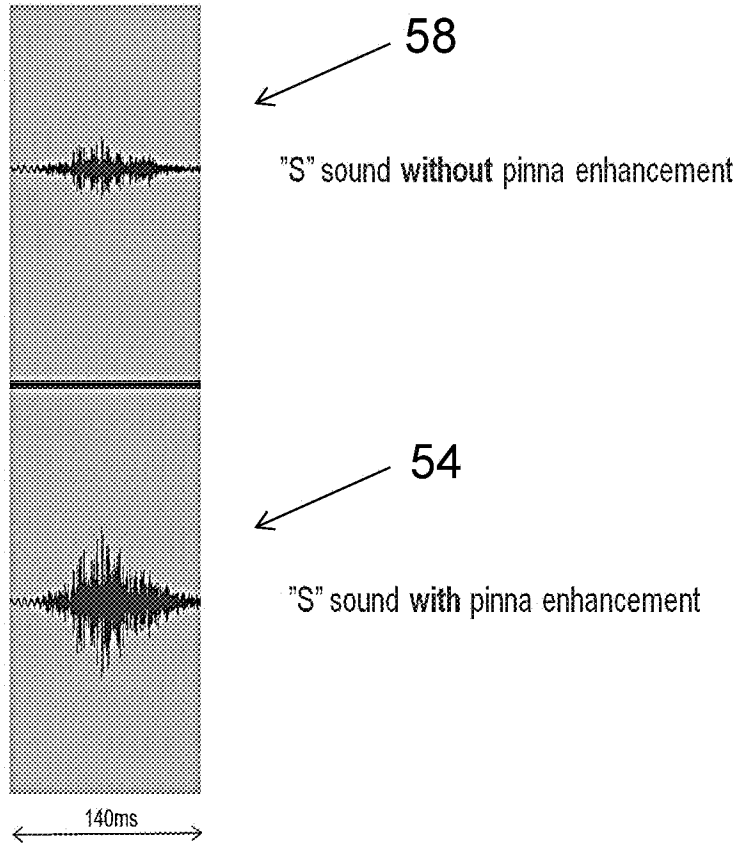
FIG. 13 shows an exemplary "s" sound without and with using the pinna enhancement mode according to an embodiment of the disclosure.

FIG. 13 shows a representation over 140 ms of an example sound of an "s" generated using the second electrical acoustic signal 58 without performing pinna enhancement mode on a hearing aid 10 and an example sound of an "s" generated using the electrical output acoustical signal 54 with pinna enhancement mode performed on a hearing aid 10. The example sound of an "s" generated using the electrical output acoustical signal 54 has a much better signal-to-noise ratio than the "s" sound without pinna enhancement mode.

Figure 14:
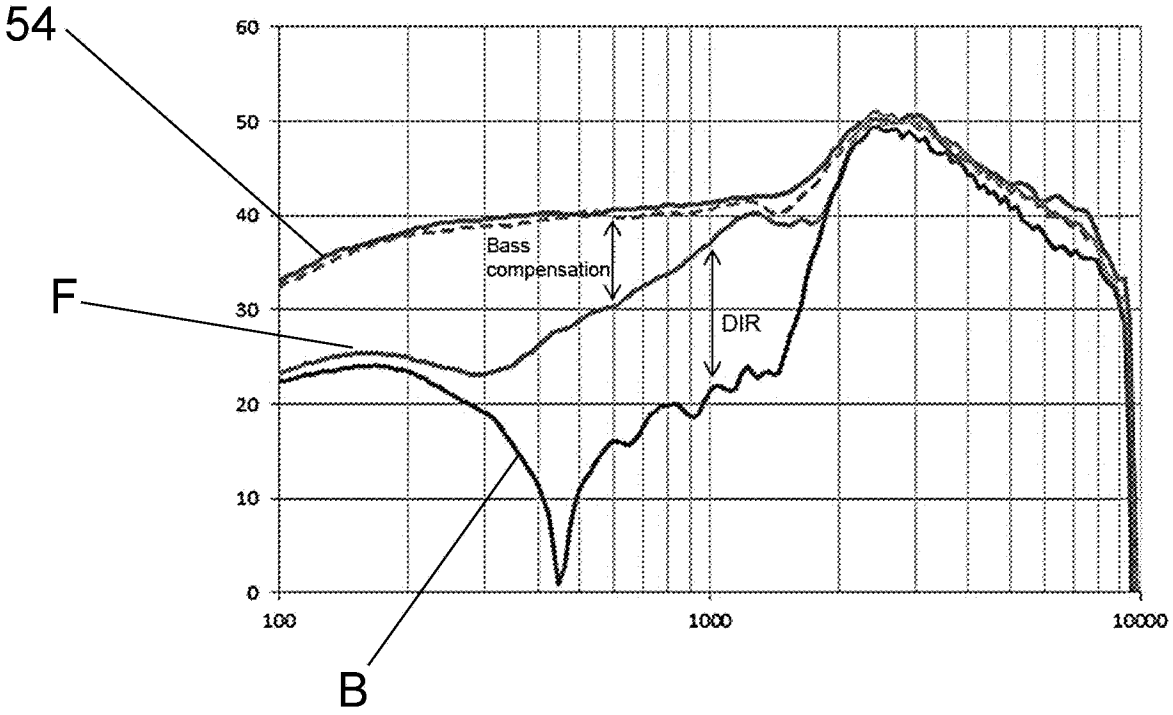
FIG. 14 shows a graph comparing the level of sound in dependence of frequency for a prior art hearing aid and a hearing aid with a first microphone arranged in an ear canal and a second microphone arranged behind an ear according to an embodiment of the disclosure.

According to an embodiment of the disclosure, the positioning of the first input sound transducer 12 relative to the second input sound transducer 14 increases distance between the two input transducers (microphones), for example increasing the distance to around 30 mm. Lower frequencies require longer distances between the microphones due to the longer wavelength of the lower-frequency sound signals. Therefore, the increased distance between the two microphones allow for achieving improved directivity for lower frequencies. The longer separation distance between the first microphone 12 and the second microphone 14 would provide a clearer difference between the electrical signals obtained from the two microphones. The directionality (low frequency directionality for instance) is based on this difference and the greater it is, the better directionality and lesser the noise. FIG. 14 shows a comparison of level of sound in dependence of frequency of electrical acoustic signals generated by a prior art hearing aid 10*a* of FIG. 11A to electrical acoustic signals generated by a hearing aid 10 of FIG. 11B obtained from exemplary free field measurements. In conventional directivity enhancement mode, the prior art hearing aid 10*a* generates a first electrical acoustic signal F for a front microphone (12, see FIG. 11A) that is arranged to the front of the hearing aid 10*a* and a second electrical acoustic signal B for a back microphone (14, see FIG. 11A) that is arranged to the back of the hearing aid 10*a*. The hearing aid 10 running in the LF directivity enhancement mode generates a level of the electrical output acoustical signal 54. The relatively lower bass compensation is required by the hearing aid 10 according to an embodiment of the disclosure, thus allowing for reducing noise significantly when compared to the hearing aid of the prior art.

Figure 15:
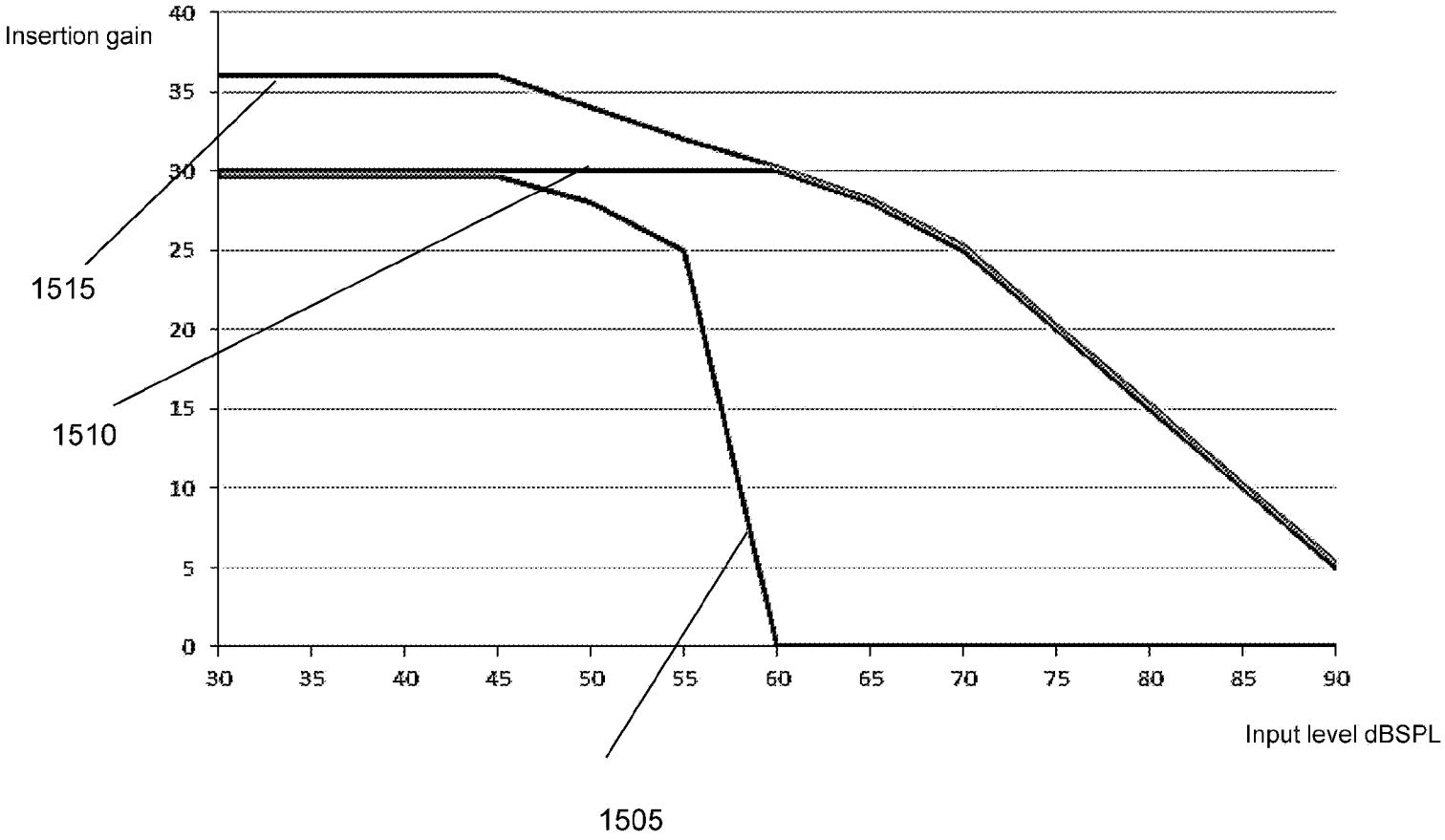
FIG. 15 illustrates operation of the dual microphone hearing aid according to an embodiment of the disclosure.

FIG. 15 illustrates operation of the dual microphone hearing aid according to an embodiment of the disclosure. When acoustic sound signals in the environment surrounding the user are soft, both the first input sound transducer 12 and the second input sound transducer 14 contribute to loudness, as illustrated by the resultant gain 1515. This resultant gain, in soft situation, is a combination of first gain 1510 relating to the first input transducer and the second gain 1505 relating to the second input transducer. This allows for reducing gain of the first input transducer 12 if only the first transducer was used alone and reducing noise while achieving the desired gain. At speech levels, the second input transducer may be turned down such that the sounds approaching from front may be focussed upon. In some instances such as speech, the second microphone 14 may be completely switched off and only the first microphone 12 is in use to allow focusing more on the sound approaching from front.

Figure 16B:
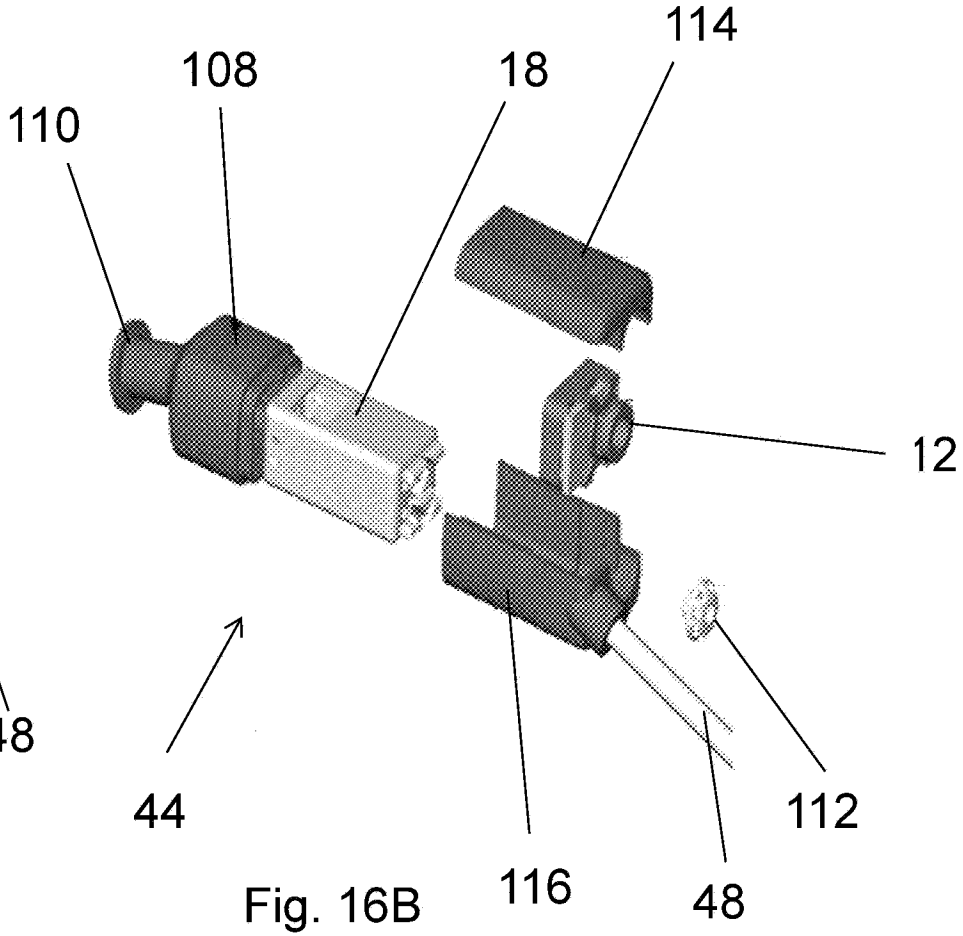
FIG. 16B shows an exploded view of the embodiment of the insertion part of the hearing aid according to an embodiment of the disclosure.
Figure 16A:
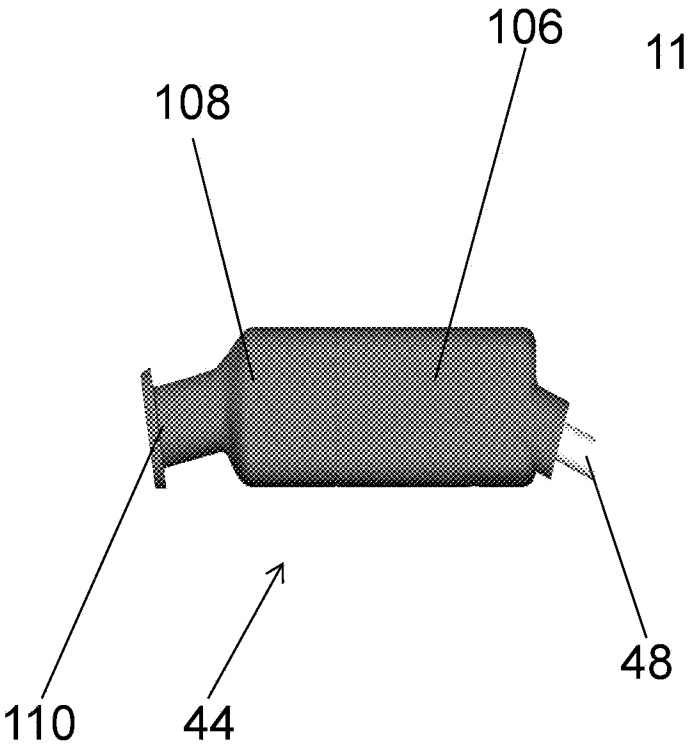
FIG. 16A shows a schematic illustration of an embodiment of an insertion part of the hearing aid.

FIG. 16 shows the insertion part 44 of a RITE style hearing aid 10 according to an embodiment of the disclosure. The insertion part 44 is connected to the BTE unit 46 via lead 48 (see FIG. 17*b*). The insertion part 44 comprises a housing comprising a front housing part 108 and a rear housing part 106. The front housing part 108 includes an in-ear speaker output 110 that is shaped to improve the acoustical output sound signals 56 generated by speaker 18 (see FIG. 1). The rear housing part 106 comprises a top cover 114 and a bottom part 116, the top cover 114 and bottom part 116 can be removably coupled with each other. The top cover 114 and the bottom part 116 in assembled form the rear housing part 106, which is removably attachable to the front housing part 108. The rear housing part 108, in assembled mode, houses the MEMS microphone 12 and at least part of the speaker 18 (see FIG. 16*b*). In order to protect the MEMS microphone 12 from clogging with ear wax, the housing 106 further comprises an exchangeable wax guard 112 in front of the cavity of the housing 106, which comprises the microphone 12. The ear wax filter 112 protects the microphone and other components placed inside the insertion part 44 and is placed at an end of the housing that is away from the ear drum when the insertion part is positioned in the ear canal. The removable top cover 114 of the housing 106 allows the insertion part 44 to be disassembled and to exchange individual components of the insertion part 44.

Using a balanced speaker 18 along with the MEMS microphone allows for manufacturing the hearing aid 10 having a very small insertion part 44 with good mechanical vibrational decoupling. The housing comprising the balanced speakers may be enclosed by an expandable balloon (not shown), which may be permanent or detachable and can be replaced. The balloon includes a sound exit hole, through which output sound signal is emitted for the user of the hearing device. Using the expandable balloon improves the fit of the earpiece in the ear canal. Such balloon arrangement is provided in US2014/0056454A1, which is incorporated herein by reference.

FIGS. 17*a* to 17*d* four different embodiments of a hearing aid with a BTE unit 46, 46*a*, 46*c* and 46*d*. The hearing aid of FIG. 17*a* corresponds to a hearing aid of prior art with first microphone 12 and second microphone 14 arranged in the BTE unit 46*a*. The hearing aids of FIGS. 17*b* to 17*d* each have a first microphone 12 arranged in the ear canal 24 and a second microphone 14 arranged in the BTE unit 46, 46*c* and 46*d*, respectively. The main difference of the hearing aids of FIGS. 17*b* to 17*d* is the shape of the body of the BTE unit 46, 46*c*, and 46*d*, respectively. The BTE unit 46*d* in FIG. 17*d* comprises a rechargeable battery in contrast to the BTE units 46, 46*a*, and 46*b* that comprise a battery 22.

It should be appreciated that reference throughout this specification to "one embodiment" or "an embodiment" or features included as "can" or "may" means that a particular feature, structure or characteristic described in connection with the embodiment is included in at least one embodiment of the disclosure. Therefore, it is emphasized and should be appreciated that two or more references to "an embodiment" or "one embodiment" or "an alternative embodiment" or features included as "can" or "may" in various portions of this specification are not necessarily all referring to the same embodiment. Furthermore, the particular features, structures or characteristics may be combined as suitable in one or more embodiments of the disclosure.

Throughout the foregoing description, for the purposes of explanation, numerous specific details were set forth in order to provide a thorough understanding of the disclosure. It will be apparent, however, to one skilled in the art that the disclosure may be practiced without some of these specific details.

Accordingly, the scope of the disclosure should be judged in terms of the claims which follow.

The invention claimed is:

1. A hearing device configured to be worn in, on, behind, and/or at an ear of a user comprising:

a first input sound transducer configured to be arranged in an ear canal or in the ear of the user, to receive acoustical sound signals from the environment and to generate first electrical acoustic signals based on the received acoustical sound signals;

a second input sound transducer configured to be arranged behind a pinna or on/behind or at the ear of the user, to receive acoustical sound signals from the environment and to generate second electrical acoustic signals based on the received acoustical sound signals;

a processing unit configured to process the first electrical acoustic signal and the second electrical acoustic signal; and an output sound transducer configured to be arranged in the ear canal of the user, wherein the processing unit is configured to determine a level of the first electrical acoustic signal, a level of the second electrical acoustic signal, and a level difference between the first electrical acoustic signal and second electrical acoustic signal and to use the level difference to process the first electrical acoustic signal and/or second electrical acoustic signal for generating an electrical output acoustical signal, wherein the output sound transducer is configured to generate an acoustical output sound signal based on the electrical output acoustical signal, wherein the hearing device comprises a filter-bank configured to filter each electrical acoustic signal into a number of frequency channels each comprising an electrical sub-band acoustic signal, and wherein the processing unit is configured to determine a level of sound for each electrical sub-band acoustic signal, wherein the processing unit is configured to determine a level difference between the first electrical sub-band acoustic signal and the second electrical sub-band acoustic signal in at least a part of the frequency channels, to convert the level difference into a gain and to apply the gain to at least a part of the electrical sub-band acoustic signals, and wherein the processing unit is configured to determine whether the level of the first electrical sub-band acoustic signal or the level of the second electrical sub-band acoustic signal is higher, and wherein the processing unit is configured to convert the level difference in a direction-dependent gain that is adapted to amplify the electrical acoustic signal, if the level of the first electrical sub-band acoustic signal is higher than the level of the second electrical sub-band acoustic signal or a combination of the first electrical sub-band acoustic signal and the second electrical sub-band acoustic signal and that is adapted to attenuate the electrical acoustic signal, if the level of the first electrical sub-band acoustic signal is lower than the level of the second electrical sub-band acoustic signal or a combination of the first electrical sub-band acoustic signal and the second electrical sub-band acoustic signal.

2. A hearing device according to claim 1, wherein the processing unit is configured to process the first electrical acoustic signal and second electrical acoustic signal for generating an electrical output acoustical signal by using i) the first electrical acoustic signal or the second electrical acoustic signal, or ii) a combination of the first and the second electrical acoustic signal to generate the electrical output acoustical signal and wherein the processing unit is further configured to compensate the first and/or the second electrical acoustic signal by the determined level difference between the first and second electrical acoustic signal.

3. A hearing device according to claim 1, wherein the processing unit is configured to use the level difference between the first electrical acoustic signal and second electrical acoustic signal to determine a direction of a sound source of the acoustical sound signal with respect to the hearing device for generating an input sound transducer directivity pattern and to amplify and/or attenuate the first or the second electrical acoustic signal or a combination of the first and second electrical acoustic signal for generating an electrical output acoustical signal in dependence of the input sound transducer directivity pattern.

4. A hearing device configured to be worn in, on, behind, and/or at an ear of a user comprising:

a first input sound transducer configured to be arranged in an ear canal or in the ear of the user, to receive acoustical sound signals from the environment and to generate first electrical acoustic signals based on the received acoustical sound signals;

a second input sound transducer configured to be arranged behind a pinna or on/behind or at the ear of the user, to receive acoustical sound signals from the environment and to generate second electrical acoustic signals based on the received acoustical sound signals;

a processing unit configured to process the first electrical acoustic signal and the second electrical acoustic signal; and an output sound transducer configured to be arranged in the ear canal of the user, wherein the processing unit is configured to determine a level of the first electrical acoustic signal, a level of the second electrical acoustic signal, and a level difference between the first electrical acoustic signal and second electrical acoustic signal and to use the level difference to process the first electrical acoustic signal and/or second electrical acoustic signal for generating an electrical output acoustical signal, wherein the output sound transducer is configured to generate an acoustical output sound signal based on the electrical output acoustical signal, wherein the hearing device comprises a filter-bank configured to filter each electrical acoustic signal into a number of frequency channels each comprising an electrical sub-band acoustic signal, and wherein the processing unit is configured to determine a level of sound for each electrical sub-band acoustic signal, and wherein the processing unit is configured to determine feedback frequency channels that do not fulfil a feedback stability criterion and to determine non-feedback frequency channels that do fulfil a feedback stability criterion or to determine feedback frequency prone channels and non-feedback frequency channels not prone to feedback corresponding to predetermined data comprising feedback and non-feedback frequency channel information.

5. A hearing device configured to be worn in, on, behind, and/or at an ear of a user comprising:

a first input sound transducer configured to be arranged in an ear canal or in the ear of the user, to receive acoustical sound signals from the environment and to generate first electrical acoustic signals based on the received acoustical sound signals;

a second input sound transducer configured to be arranged behind a pinna or on/behind or at the ear of the user, to receive acoustical sound signals from the environment and to generate second electrical acoustic signals based on the received acoustical sound signals;

a processing unit configured to process the first electrical acoustic signal and the second electrical acoustic signal; and an output sound transducer configured to be arranged in the ear canal of the user, wherein the processing unit is configured to determine a level of the first electrical acoustic signal, a level of the second electrical acoustic signal, and a level difference between the first electrical acoustic signal and second electrical acoustic signal and to use the level difference to process the first electrical acoustic signal and/or second electrical acoustic signal for generating an electrical output acoustical signal, wherein the output sound transducer is configured to generate an acoustical output sound signal based on the electrical output acoustical signal, wherein the hearing device comprises a filter-bank configured to filter each electrical acoustic signal into a number of frequency channels each comprising an electrical sub-band acoustic signal, and wherein the processing unit is configured to determine a level of sound for each electrical sub-band acoustic signal, and wherein the processing unit is configured to apply the direction-dependent gain to second electrical sub-band acoustic signals or to a weighted sum of the first electrical sub-band acoustic signal and the second electrical sub-band acoustic signal from feedback frequency channels and first electrical sub-band acoustic signals from non-feedback frequency channels in order to generate the electrical output sound signal.

6. A hearing device according to claim 1, wherein the processing unit is configured to determine a direction-dependent gain for frequency bands between 2000 and 5000 Hz and to apply the gain derived from the level difference determined for a frequency band above 2000 Hz to selected frequency bands below 2000 Hz and to apply the level difference determined for a frequency band below 5000 Hz to selected frequency bands above 5000 Hz.

7. A hearing device according to claim 4, wherein the processing unit is configured to use second electrical sub-band acoustic signals from feedback frequency channels and first electrical sub-band acoustic signals from non-feedback frequency channels in order to generate the electrical output acoustical signal and wherein the processing unit is further configured to compensate each respective first or second electrical sub-band acoustic signal or a combination of the respective first and second electrical sub-band acoustic signal from each respective feedback frequency channel in dependence of the level difference between the first and second electrical sub-band acoustic signal.

8. A hearing device according to claim 1, wherein the processing unit is configured to limit the value of the level difference to a threshold value of level difference.

9. A hearing device according to claim 1, wherein the processing unit is configured to estimate a feedback path between the first input sound transducer and the output sound transducer and a feedback path between the second input sound transducer and the output sound transducer.

10. A hearing device configured to be worn in, on, behind, and/or at an ear of a user comprising:

a first input sound transducer configured to be arranged in an ear canal or in the ear of the user, to receive acoustical sound signals from the environment and to generate first electrical acoustic signals based on the received acoustical sound signals;

a second input sound transducer configured to be arranged behind a pinna or on/behind or at the ear of the user, to receive acoustical sound signals from the environment and to generate second electrical acoustic signals based on the received acoustical sound signals;

a processing unit configured to process the first electrical acoustic signal and the second electrical acoustic signal; and an output sound transducer configured to be arranged in the ear canal of the user, wherein the processing unit is configured to determine a level of the first electrical acoustic signal, a level of the second electrical acoustic signal, and a level difference between the first electrical acoustic signal and second electrical acoustic signal and to use the level difference to process the first electrical acoustic signal and/or second electrical acoustic signal for generating an electrical output acoustical signal, wherein the output sound transducer is configured to generate an acoustical output sound signal based on the electrical output acoustical signal, and wherein the two first and second input sound transducers and the output sound transducer are arranged in the same horizontal plane and wherein the processing unit is configured to determine a cross correlation between the feedback path between the first input sound transducer and the output sound transducer and the feedback path between the second input sound transducer and the output sound transducer and wherein the processing unit is configured to use the cross correlation to determine a distance or delay or phase difference between the first input sound transducer and the second input sound transducer.

11. A hearing device according to claim 10, wherein the processing unit is configured to select a directional filter optimized for the directionality in lower frequencies based on the distance between the first input sound transducer and the second input sound transducer.

12. A method for processing acoustical sound signals from the environment comprising feedback, comprising the steps:

receiving an acoustical sound signal in an ear or in an ear canal of a user and generating a first electrical acoustic signal and receiving the acoustical sound signal behind a pinna or on/behind or at the ear of the user and generating a second electrical acoustic signal;

filtering the electrical acoustic signals into frequency channels generating first electrical sub-band acoustic signals and second electrical sub-band acoustic signals;

estimating the level of sound of each first and second electrical sub-band acoustic signal in each frequency channel;

determining the level difference between each first and second electrical sub-band acoustic signal in the respective frequency channel;

converting the value of the level difference into a gain value for each frequency channel;

applying the gain to electrical sub-band acoustic signals; and synthesizing an electrical output acoustical signal from the electrical sub-band acoustic signals, wherein the gain is applied to the second electrical sub-band acoustic signals in feedback frequency channels, which do not fulfil a feedback stability criterion in order to generate compensated second electrical sub-band acoustic signals in the feedback frequency channels, wherein the gain is applied to the first electrical sub-band acoustic signals in non-feedback frequency channels, which fulfil a feedback stability criterion in order to generate compensated first electrical sub-band acoustic signals in the non-feedback frequency channels, and wherein an electrical output acoustical signal is synthesized from the compensated second electrical sub-band acoustic signals and the compensated first electrical sub-band acoustic signals.

13. A method for processing acoustical sound signals from the environment comprising feedback, comprising the steps:

receiving an acoustical sound signal in an ear or in an ear canal of a user and generating a first electrical acoustic signal and receiving the acoustical sound signal behind a pinna or on/behind or at the ear of the user and generating a second electrical acoustic signal;

filtering the electrical acoustic signals into frequency channels generating first electrical sub-band acoustic signals and second electrical sub-band acoustic signals;

estimating the level of sound of each first and second electrical sub-band acoustic signal in each frequency channel;

determining the level difference between each first and second electrical sub-band acoustic signal in the respective frequency channel;

converting the value of the level difference into a gain value for each frequency channel;

applying the gain to electrical sub-band acoustic signals; and synthesizing an electrical output acoustical signal from the electrical sub-band acoustic signals, wherein the step of converting the value of the level difference into a gain value for each frequency channel, converts the value of the level difference into a direction-dependent gain value that is adapted to amplify the electrical acoustic signal, if the level of the first electrical sub-band acoustic signal is higher than the level of the second electrical sub-band acoustic signal and that is adapted to attenuate the electrical acoustic signal, if the level of the first electrical sub-band acoustic signal is lower than the level of the second electrical sub-band acoustic signal and wherein the direction dependent gain is applied to electrical sub-band acoustic signals and an electrical output acoustical signal is synthesized from the electrical sub-band acoustic signals.

14. A hearing device according to claim 5, wherein the processing unit is configured to determine a direction-dependent gain for frequency bands between 2000 and 5000 Hz and to apply the gain derived from the level difference determined for a frequency band above 2000 Hz to selected frequency bands below 2000 Hz and to apply the level difference determined for a frequency band below 5000 Hz to selected frequency bands above 5000 Hz.

15. A hearing device according to claim 1, wherein said hearing device is a hearing aid.

16. A hearing device according to claim 4, wherein said hearing device is a hearing aid.

17. A hearing device according to claim 5, wherein said hearing device is a hearing aid.

18. A hearing device according to claim 10, wherein said hearing device is a hearing aid.

* * * * *